US005644332A

United States Patent [19]

Matsuzaki et al.

[11] Patent Number: 5,644,332

[45] Date of Patent: Jul. 1, 1997

[54] APPARATUS AND METHOD FOR CONTROLLING DRIVE OF A DISPLAY DEVICE IN ACCORDANCE WITH THE NUMBER OF SCANNING LINES TO BE UPDATED

[75] Inventors: Eiichi Matsuzaki, Kawasaki; Kenzo Ina, Yokohama; Hiroshi Nonoshita, Fujisawa; Yoshitsugu Yamanashi, Tokyo, all of Japan

[73] Assignee: Canon Kabushiki Kaisha, Tokyo, Japan

[21] Appl. No.: 402,986

[22] Filed: Mar. 13, 1995

Related U.S. Application Data

[63] Continuation of Ser. No. 921,830, Jul. 30, 1992, abandoned.

[30] Foreign Application Priority Data

| | | | |
|---|---|---|---|
| Aug. 2, 1991 | [JP] | Japan | 3-194178 |
| Aug. 2, 1991 | [JP] | Japan | 3-194260 |
| Aug. 2, 1991 | [JP] | Japan | 3-194261 |
| Aug. 2, 1991 | [JP] | Japan | 3-194262 |
| Sep. 9, 1991 | [JP] | Japan | 3-228919 |
| Sep. 9, 1991 | [JP] | Japan | 3-228921 |

[51] Int. Cl.[6] ..... G09G 3/36

[52] U.S. Cl. ..... 345/100

[58] Field of Search ..... 345/98, 99, 100, 345/101

[56] References Cited

FOREIGN PATENT DOCUMENTS

| | | |
|---|---|---|
| 0318050 | 5/1989 | European Pat. Off. . |
| 0314084 | 5/1989 | European Pat. Off. . |
| 0361471 | 4/1990 | European Pat. Off. . |
| 0368117 | 5/1990 | European Pat. Off. . |
| 62-076357 | 4/1987 | Japan . |

*Primary Examiner*—Jeffery Brier

*Attorney, Agent, or Firm*—Fitzpatrick, Cella, Harper & Scinto

[57] ABSTRACT

Display drive of a ferroelectric liquid crystal (FLC) display device is controlled in accordance with temperature and the number of lines to be displayed and updated. An interlace or non-interlace mode for driving the display device is selected on the basis of the number of scanning lines to be updated and/or the temperature. A table is provided for changing the interlace mode on the basis of various conditions.

14 Claims, 23 Drawing Sheets

FIG. 19

| ADDRESS | 32 INTERLACE | 16 INTERLACE | 8 INTERLACE | 4 INTERLACE |
|---|---|---|---|---|
| 0 | 1 | 1 | 1 | 1 |
| 1 | 33 | 17 | 9 | 5 |
| 2 | 65 | 33 | 17 | 9 |
| 3 | 97 | 49 | 25 | 13 |
| 4 | 129 | 65 | 33 | 17 |
| 5 | 161 | 81 | 41 | 21 |
| ⋮ | ⋮ | ⋮ | ⋮ | ⋮ |
| | | | | 2 |
| | | | | 6 |
| | | | 2 | 10 |
| | | | 10 | ⋮ |
| | | 2 | 18 | ⋮ |
| | | 18 | ⋮ | ⋮ |
| K | 2 | 34 | ⋮ | ⋮ |
| ⋮ | 34 | ⋮ | ⋮ | ⋮ |
| | 66 | ⋮ | ⋮ | ⋮ |
| | ⋮ | ⋮ | ⋮ | ⋮ |
| N-1 | ⋮ | ⋮ | ⋮ | ⋮ |
| N | ⋮ | ⋮ | ⋮ | ⋮ |

FIG. 20

| ADDRESS | 10-32 INTERLACE | 10-16 INTERLACE | 14-16 INTERLACE | ----- | 100 INTERLACE |
|---|---|---|---|---|---|
| 0 | 1 | 1 | 1 | --- | 1 |
| 1 | 2 | 2 | 2 | --- | 2 |
| 2 | 3 | 3 | 3 | --- | 3 |
| 3 | 4 | ⋮ | ⋮ | ⋮ | 4 |
| 4 | 5 | ⋮ | ⋮ | ⋮ | ⋮ |
| ⋮ | ⋮ | ⋮ | ⋮ | ⋮ | ⋮ |
| 9 | 10 | 10 | ⋮ | ⋮ | ⋮ |
| 10 | 321 | 161 | ⋮ | ⋮ | ⋮ |
| 11 | 322 | 162 | ⋮ | ⋮ | ⋮ |
| 12 | 323 | 163 | ⋮ | ⋮ | ⋮ |
| ⋮ | ⋮ | ⋮ | 14 | ⋮ | ⋮ |
| 19 | 330 | ⋮ | 225 | ⋮ | ⋮ |
| 20 | 641 | ⋮ | 226 | ⋮ | ⋮ |
| 21 | 642 | ⋮ | ⋮ | ⋮ | ⋮ |
| ⋮ | ⋮ | ⋮ | ⋮ | ⋮ | ⋮ |
| 29 | 650 | ⋮ | ⋮ | ⋮ | ⋮ |
| 30 | 961 | ⋮ | ⋮ | ⋮ | ⋮ |
| ⋮ | ⋮ | ⋮ | ⋮ | ⋮ | 98 |
| ⋮ | ⋮ | ⋮ | ⋮ | ⋮ | 99 |
| ⋮ | K | ⋮ | ⋮ | ⋮ | 100 |
| ⋮ | 11 | ⋮ | ⋮ | ⋮ | 101 |
| ⋮ | 12 | ⋮ | ⋮ | ⋮ | ⋮ |
| K | ⋮ | ⋮ | ⋮ | ⋮ | N |

FIG. 22

| INTERLACE FLAG / ADDRESS | "00" (32 INTERLACE) | "01" (16 INTERLACE) | "10" (8 INTERLACE) | "11" (4 INTERLACE) |
|---|---|---|---|---|
| 0 | 1 | 1 | 1 | 1 |
| 1 | 33 | 17 | 9 | 5 |
| 2 | 65 | 33 | 17 | 9 |
| 3 | 97 | 49 | 25 | 13 |
| 4 | 129 | 65 | 33 | 17 |
| 5 | 161 | 81 | 41 | 21 |
| ⋮ | ⋮ | ⋮ | ⋮ | ⋮ |
| | | | | 2 |
| | | | | 6 |
| | | | | 10 |
| | | | 2 | ⋮ |
| | | | 10 | |
| | | | 18 | |
| | | 2 | ⋮ | |
| | | 18 | | |
| | | 34 | | |
| K | 2 | ⋮ | | |
| ⋮ | 34 | | | |
| | 66 | | | |
| | ⋮ | | | |
| N-1 | | | | |
| N | | | | |

FIG. 23

| SAMPLING COUNTER | TEMPERATURE FLAG | INTERLACE FLAG |
|---|---|---|
| 0~511 | 0 0 | 0 0 |
| | 0 1 | 0 1 |
| | 1 0 | 1 0 |
| | 1 1 | 1 1 |
| 512~1023 | 0 0 | 0 1 |
| | 0 1 | 1 0 |
| | 1 0 | 1 1 |
| | 1 1 | 1 1 |
| 1024~1535 | 0 0 | 1 1 |
| | 0 1 | 1 1 |
| | 1 0 | 1 1 |
| | 1 1 | 1 1 |
| 1536~ | 0 0 | 1 1 |
| | 0 1 | 1 1 |
| | 1 0 | 1 1 |
| | 1 1 | 1 1 |

FIG. 24

| FLAG | SW A | SW B |
|---|---|---|
| 0 0 | <5℃ | <10℃ |
| 0 1 | 5℃≦ <10℃ | 10℃≦ <15℃ |
| 1 0 | 10℃≦ <30℃ | 15℃≦ <35℃ |
| 1 1 | 30℃≦ | 35℃≦ |

APPARATUS AND METHOD FOR CONTROLLING DRIVE OF A DISPLAY DEVICE IN ACCORDANCE WITH THE NUMBER OF SCANNING LINES TO BE UPDATED

This application is a continuation of application Ser. No. 07/921,830, filed Jul. 30, 1992, now abandoned.

BACKGROUND OF THE INVENTION

1. Field of the Invention

The invention relates to a display control apparatus and, more particularly, to a display control apparatus for a display apparatus having a display device which uses, for instance, a ferroelectric liquid crystal as an operational medium to display and update and which can hold a display state updated by applying an electric field or the like.

2. Related Background Art

Generally, an information processing system or the like uses a display apparatus as information display means which performs a visual expressing function of information. A CRT display apparatus is widely known as such a display apparatus.

In the display control in the CRT display apparatus, the writing operation of a CPU on the system side to a video memory serving as a display data buffer and the reading and displaying operations of the display data from the video memory are respectively independently executed by, for example, a CRT controller.

In case of the display control of the CRT as mentioned above, the writing operation of the display data to the video memory to change the display information or the like and the operations for reading out the display data from the video memory and displaying are independently executed, so that there is an advantage such that there is no need to consider the display timing or the like in the program on the information processing system side and desired display data can be written at an arbitrary timing.

On the contrary, however, a whole volume of the CRT is large because in particular, a certain degree of length in the thickness direction of the display screen is necessary, so that it is difficult to miniaturize the whole display apparatus. Consequently, when the information processing system using such a CRT as a display is used, degrees of freedom, namely, degrees of freedom of the installing location, portability, and the like are lost.

A liquid crystal display (hereinafter, referred to as an LCD) can be used as a display apparatus which can eliminate the above drawback. That is, according to the LCD, miniaturization of the whole display apparatus (particularly, the apparatus is made thin) can be realized. As such an LCD, there is a display (hereinafter, referred to as an FLCD: FLC display) using a liquid crystal cell of a ferroelectric liquid crystal (hereinafter, referred to as an FLC). If is a feature of such an FLCD that the liquid crystal cell has a preservation performance of the display state for the supply of an electric field. That is, the liquid crystal cell of the FLCD is thin enough and molecules of the elongated FLC in the liquid crystal cell are oriented in the first or second stable state in accordance with the applying direction of the electric field and maintains each orientation state even when the electric field is extinguished. The FLCD has a memory performance by the bistability of such FLC molecules. The details of such an FLC and an FLCD are disclosed in, for instance, Japanese Patent Application No. 62-76357.

Although the FLCD has the memory performance as mentioned above, since a speed regarding the display updating operation of the FLC is relatively slow, there is a case where the FLCD cannot follow a change in display information such as movement of a cursor, character input, scroll, or the like in which the display content must be quickly rewritten.

In the FLCD having such contradictory characteristics, in accordance with those characteristics or in order to compensate those characteristics, various driving methods of displaying can be considered. That is, with respect to a refresh driving method of sequentially continuously driving scan lines on the display screen in a manner similar to the case of the CRT or other liquid crystal displays, the driving period has relatively a surplus in terms of the time. In addition to the above refresh driving method, a partial rewriting driving method of updating the display state of only a portion (line) corresponding to the change on the display screen or an interlace driving method of driving while thinning out the scan lines on the display screen can be performed. A tracking performance for a change in display information can be improved by the partial rewriting driving method or interlace driving method mentioned above.

On the other hand, if such an FLCD and a CRT can be used with a compatibility as a display apparatus of the information processing system, a flexibility of the system increases and its value can be raised.

Since various kinds of driving methods can be performed in the FLCD as mentioned above, it is important to select the proper driving method in accordance with the display information (character, graphics, natural image, etc.) or a display changing mode (still image, moving image, scroll, etc.).

For example, in the scroll display mode among the display changing modes, it is necessary to perform a rewriting operation (display change) at a relatively high speed on the whole display screen and it is necessary to assure a picture quality such that display information such as characters or the like which are displayed can be clearly recognized in this instance. It is, therefore, necessary to select the optimum driving method in the scroll display mode. For this purpose, however, the setting of the scroll display mode must be certainly recognized on the display control apparatus side.

In case of using the FLCD as a display apparatus of the information processing system while keeping the compatibility with the CRT, however, the CPU on the system side merely transmits the display data regarding the display change and its address to the display apparatus side. Consequently, there is a problem regarding how to certainly recognize the scroll mode on the basis of the transmission of the display data and address.

SUMMARY OF THE INVENTION

It is an object of the invention to provide a display control apparatus of an FLCD or the like having a compatibility with a CRT without largely changing a software of an information processing system.

The invention further intends to provide a display control apparatus which can realize the optimum picture quality by effectively using the preservation performance of a display state in the FLCD or the like.

Still another object of the invention is to provide a display control apparatus which can detect a state of display information or a display changing mode and can select the optimum interlace mode according to the result of the detection.

Further another object of the invention is to provide a display control apparatus which can certainly recognize the scroll display mode from display data or address data that is supplied.

BRIEF DESCRIPTION OF THE DRAWINGS

FIG. 19 is an explanatory diagram showing an interlace table according to an embodiment of the invention;.

FIG. 20 is an explanatory diagram showing an interlace table according to an embodiment of the invention,.

FIG. 22 is a conceptional diagram of an address conversion table shown in FIG. 21;

FIG. 23 is a conceptional diagram of an interlace flag table shown in FIG. 21; and FIG. 24 is a conceptional diagram of a temperature flag table which a temperature controller shown in FIG. 21 has.

DETAILED DESCRIPTION OF THE PREFERRED EMBODIMENTS

Figure 1:
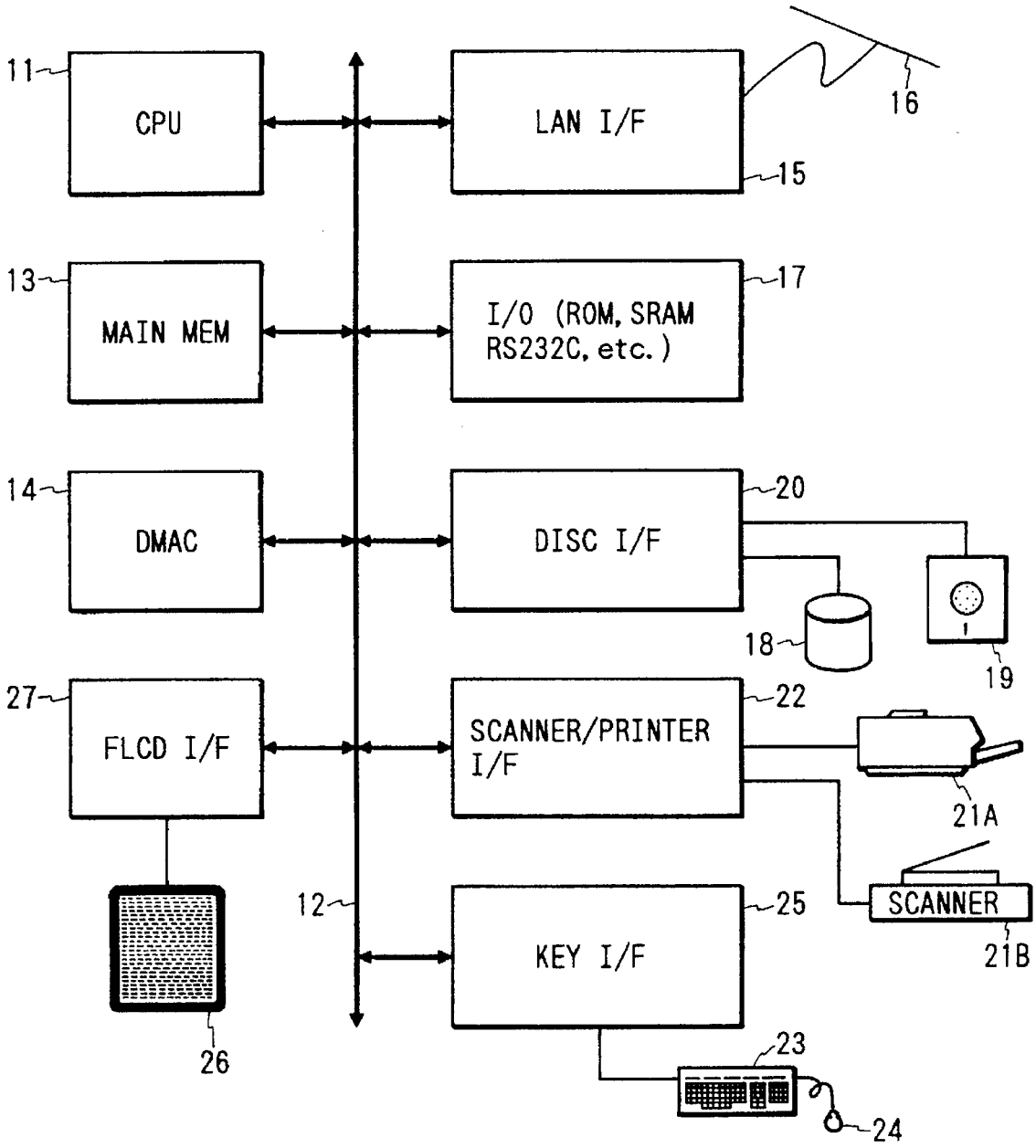
FIG. 1 is a block diagram of an information processing system having a display control apparatus therein according to an embodiment of the invention.

FIG. 1 is a block diagram of an information processing system in which an FLC display apparatus having a display control apparatus according to an embodiment of the invention is used as a display apparatus of various characters, image information, or the like.

In the diagram, reference numeral 11 denotes a CPU to control the whole information processing system; 13 a main memory in which a program to be executed by the CPU 11 is stored and which is used as a work area upon execution of the program; 14 a DMA controller (Direct Memory Access Controller; hereinafter, referred to as a DMAC) to transfer data between the main memory 13 and various apparatuses constructing the system without passing through the control of the CPU 11; 15 an LAN (Local Area Network) interface between an LAN 16 and the system; and 17 an input/output device (hereinafter, referred to as an I/O) having an ROM, an SRAM, an interface of the RS232C type, and the like. Various kinds of external apparatuses can be connected to the I/O 17. Reference numeral 18 denotes a hard disc device and a floppy disk device 19 serving as external memory devices; 20 a disc interface to connect signals between the hard disc device 18 and floppy disk device 19 and the system; 21A a laser beam printer (hereinafter, simply referred to as a printer) which can record at a relatively high resolution; 21B a scanner as an image reading device; 22 a scanner/printer interface to connect signals between the printer 21A and scanner 21B and the system; 23 a keyboard to input various character information, control information, or the like; 24 a mouse as a pointing device; 25 a key interface to connect signals between the keyboard 23 and mouse 24 and the system; and 26 an FLC display apparatus (hereinafter, referred to as an FLCD) whose display is controlled by an FLCD interface 27 as a display control apparatus according to an embodiment of the invention. The FLCD 26 has a display screen using the above ferroelectric liquid crystal as a display operation medium. Reference numeral 12 denotes a system bus comprising a data bus, a control bus, and an address bus to connect signals among the above apparatuses and devices.

In the information processing system to which the above-mentioned various apparatuses and devices and the like are connected, generally, the user of the system executes an operation in correspondence to various information displayed on the display screen of the FLCD 26. This is, the character or image information or the like which is supplied from the external apparatuses which are connected to the LAN 16 and I/O 17, the hard disc device 18, floppy disk device 19, scanner 21B, keyboard 23, and mouse 24, and the operation information which relates the system operation of the user and is stored in the main memory 13, and the like are displayed on the display screen of the FLCD 26. The user executes an edition of the information or an instructing operation to the system while observing the display contents on the screen. The above various kinds of apparatuses and devices and the like construct display information supplying means to the FLCD 26.

(First embodiment)

Figure 2:
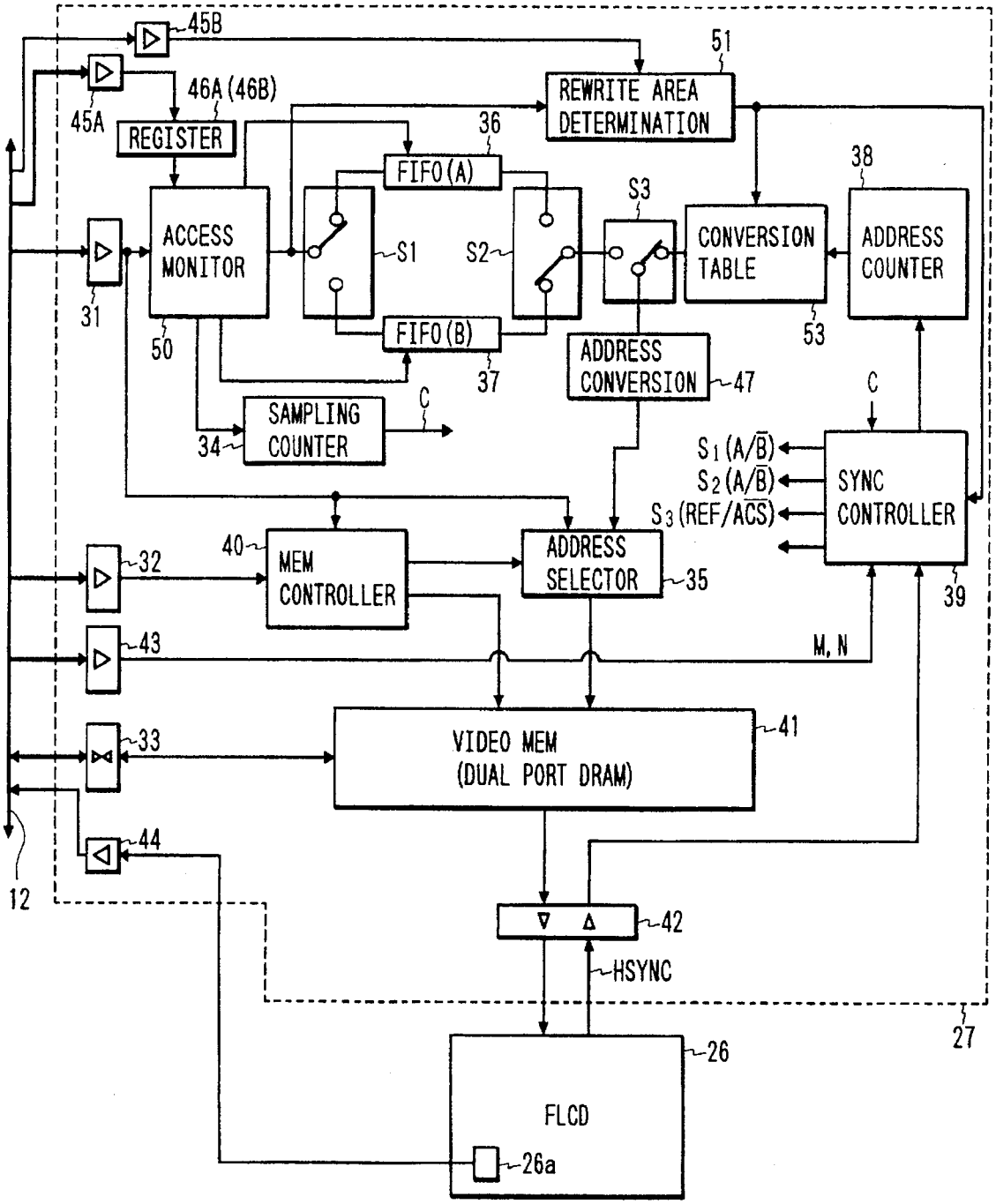
FIG. 2 is a block diagram showing a construction of an FLCD interface according to the first embodiment of the invention.

FIG. 2 is a block diagram showing the details of the FLCD interface 27 according to the first embodiment of the invention.

In the diagram, reference numeral 31 denotes an address bus driver; 32 a control bus driver; 33, 43, 44, and 45 data bus drivers which are connected to each bus of the system bus 12. Absolute address data when the CPU 11 accesses a video RAM (hereinafter, referred to as a VRAM) on the system side in order to perform the rewriting operation of the display content or the like is given to an access monitor circuit 50 through the address bus driver 31. The absolute address (data) supplied to the access monitor circuit 50 is converted into a line address (data) corresponding to a scan line on the display screen and is selectively written into a first-in first-out memory (hereinafter, referred to as an FIFO) (A) 36 or an FIFO (B) 37 in accordance with a write signal that is supplied from the access monitor circuit 50. The selection between the FIFO (A) 36 and the FIFO (B) 37 is executed in accordance with the switching of a switch $S_1$. The FIFO (A) 36 and FIFO (B) 37 are the memories from which the data is read out in accordance with the writing order. Line address data written in the FIFO (A) 36 and FIFO (B) 37 is selectively read out in accordance with the switching of a second switch $S_2$. The access monitor circuit 50 supplies the line address data to a rewrite area determination circuit 51, which will be explained hereinlater with reference to FIG. 3.

When the CPU 11 discriminates the address data to access a memory 41 and different addresses are accessed for a predetermined period of time, the access monitor circuit 50 further generates the address data to a sampling counter 34. The sampling counter 34 counts the number of data generated. A counted value is given to a sync controller 39 and used to decide a ratio between the partial rewriting and the refresh driving or the like.

The absolute address data which is supplied through the address bus driver 31 is also given to an address selector 35. The CPU 11 accesses the video memory 41 on the basis of the absolute address data.

The address data which has been read out from the FIFO (A) 36 or FIFO (B) 37 and the address data which has been generated from an address counter 38 and transmitted through an address conversion table 53, which will be explained hereinlater, are selectively given to one input terminal of the address selector 35 through an address conversion circuit 47, which will be explained hereinlater, in accordance with the switching of a third switch $S_3$. The address counter 38 increases a line address for the video memory 41 by "1" at a time and generates address data to refresh drive the whole display screen. A generation timing of the address data is controlled by the sync control circuit 39.

The sync control circuit 39 generates switching control signals for the switches $S_1$, $S_2$, and $S_3$ and a data transfer request signal to a memory controller 40, which will be explained hereinlater. The generation timing of the data transfer request signal and the switching timings of the switches $S_1$, $S_2$, and $S_3$ are controlled by the sync control circuit 39 in accordance with a horizontal sync signal (HSYNC) which is given from the FLCD 26 each time the display driving of one line of the display screen is executed.

A control signal which is given from the CPU 11 is supplied to the memory controller 40 through the control bus driver 32. The memory controller 40 controls the address selector 35 and video memory 41 on the basis of the control signal. That is, the memory controller 40 performs the arbitration between the memory access request signal which is generated from the CPU 11 when the data in the video memory 41 is rewritten or the like and the data transfer request signal which is generated from the sync control circuit 39 when the data in the video memory 41 is displayed. On the basis of the result of the arbitration, the address selector 35 selects either one of the two address data which are given to the input terminals of the address selector 35 and supplies to the video memory 41.

The video memory 41 stores display data and is constructed by a dual-port DRAM (dynamic RAM). The display data which is supplied through the data bus driver 33 is written into memory location in the video memory 41 designated by the address that is given from the address selector 35. The display data stored in the video memory 41 is read out from the memory location designated by the address given from the address selector 35 and is supplied to the FLCD 26 through a driver receiver 42 and is displayed. The driver receiver 42 transfers the horizontal sync signal HSYNC given from the FLCD 26 to the sync control circuit 39.

The data to set the ratio between the partial rewriting and the refresh driving or the like is supplied from the CPU 11 to the sync control circuit 39 through the data bus driver 43.

A temperature sensor **26*a* to detect a temperature of FLC panel of the FLCD 26 is provided for the FLC panel. An output signal of the temperature sensor 26*a* is transferred to the CPU 11 through the data bus driver 44**.

In the above construction shown in FIG. 2, when the CPU 11 changes the display content, the address in the video memory 41 corresponding to a portion into which the data to be changed is written is supplied to the memory controller 40. In response to such an address, the memory controller 40 executes the arbitration between the memory access request signal given from the CPU 11 and the data transfer request signal given from the sync control circuit 39. When the CPU 11 obtains the right to access, the memory controller 40 instructs the switching operation to the address selector 35 so as to select the address from the address bus driver 31, namely, the address that is at present being accessed by the CPU 11 as an address which is given to the video memory 41. At the same time, a control signal is given from the memory controller 40 to the video memory 41 and the writing operation of the data given through the data bus driver 33, that is, the rewriting operation of the data in the video memory 41 is executed. In this instance, the address data which is accessed by the CPU 11 is stored into the FIFO (A) 36 or FIFO (B) 37 through the access monitor circuit 50 and switch $S_1$ and is used when transferring the display data, which will be explained hereinlater. An accessing method of the display data when it is seen from the CPU 11 as mentioned above is similar to the method in case of the CRT.

On the other hand, in the case where the data is read out from the video memory 41 and is transferred to the FLCD 26 and displayed, the data transfer request signal is given from the sync control circuit 39 to the memory controller 40. As an address to the video memory 41, the address of the address counter 38 or on the FIFO side is selected by the address selector 35 through the address conversion circuit 47 in accordance with the switching of the switch $S_3$ and is given to the video memory 41. At the same time, a control signal for data transfer is supplied from the memory controller 40 to the video memory 41. The display data of the line corresponding to the relevant address is transferred from the memory cell in the video memory 41 to the shift register and is supplied to the driver receiver 42 by a control signal of a serial port.

The sync control circuit 39 switches the switch $S_3$ on the basis of the horizontal sync signal HSYNC which is given from the FLCD 26 as mentioned above, thereby causing a cycle to refresh the whole surface of the display screen or a partial rewriting cycle to rewrite the line accessed by the CPU 11. The sync control circuit 39 also switches the switch $S_3$ in accordance with a driving mode selection signal from the rewrite area determination circuit 51, which will be explained hereinlater by using FIG. 3. The cycle to refresh the whole surface denotes a cycle to sequentially display drive the lines constructing the display screen one line by one and is executed in a manner such that the line to be accessed sequentially changes one line by one in accordance with the address which is sequentially increased by the address counter 38, as will be explained hereinlater. The partial rewriting cycle of the access line denotes a cycle to rewrite the line accessed from the CPU 11 within a predetermined time just before such a cycle.

The address conversion table 53 has a table to directly generate the address data which is supplied from the address counter 38 and an interlace table to convert the address so as to display in the interlace mode. One of those tables is selected in accordance with a selection signal which is supplied from the rewrite area determination circuit 51, will be explained in detail with reference to FIG. 3.

As will be explained hereinlater with reference to FIGS. 19 and 20, the interlace table has a plurality of tables for the interlace mode in which the number of lines to be thinned out is constant and a plurality of tables for the interlace mode in which the number of lines to be thinned out irregularly changes. In the scroll display mode, as will be explained hereinlatr, none of the above interlace tables is selected but a non-interlace table in which the address data supplied from the address counter 38 is generated as it is selected through the switch $S_3$.

The address conversion circuit 47 converts the line address data corresponding to each scan line of the display screen into the address data to access the video memory 41.

As mentioned above, as for the address data to access the video memory 41 to display, the address data to refresh the whole display screen of the FLCD 26 and the address data to partially rewrite the line accessed by the CPU 11 in order to change the display content are fundamentally time-sharingly generated in accordance with the switching of the switch $S_3$. However, in addition to the address to partially rewrite or to refresh, an address of the interlace mode which is suitable for a predetermined display state can be set by the rewrite area determination circuit 51.

Figure 3:
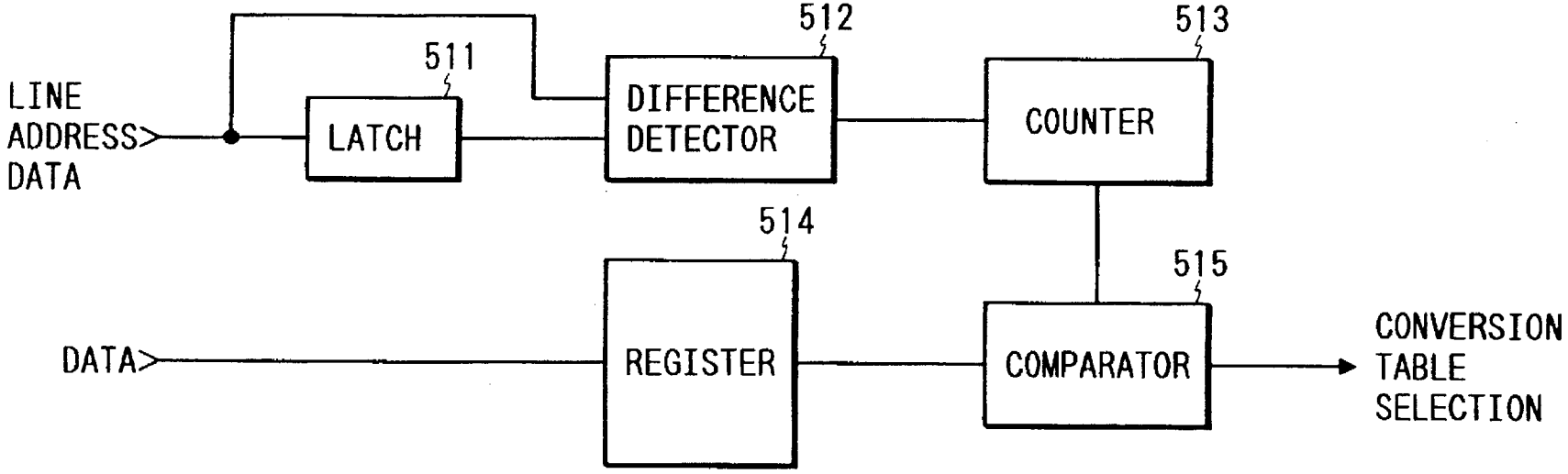
FIG. 3 is a block diagram showing the details of a rewrite area designation circuit shown in FIG. 2.

FIG. 3 is a block diagram showing the details of the rewrite area determination circuit 51 shown in FIG. 2.

The address data for the CPU 11 to access the video memory 40 in order to rewrite (change the display content) is supplied as line address data to the rewrite area determination circuit 51 through the access monitor circuit 50. Reference data which has been supplied through a data bus driver 45B shown in FIG. 2 and is used to set the conversion table is set into a register 514. A plurality of reference data are set into the register 514 in accordance with the inputting order.

The line address supplied to the rewrite area determination circuit 51 is sent to a latch 511 and a difference detector 512. A difference between the supplied line address and the address data which is generated from the latch 511 and is preceding by one timing is detected by the detector 512. Such a difference indicates a difference between the address data which have been sequentially supplied to the difference detector 512. When the difference is equal to 1, this means that the continuous scan lines of the display screen are rewritten. When the difference is equal to 1, the difference detector 512 generates a signal and a counter 513 counts the number of such signals generated. In the above counting operation, only when the signals are continuously generated from the difference detector 512 at predetermined timings, the number of signals is counted. When the signal generation is stopped, the counted value is cleared.

A comparator 515 compares the count value of the counter 513 which has been successively counted and each of a plurality of data which are stored into the register 514, thereby detecting whether the count value of the counter 513 lies within which range of those plurality of data. The comparator 515 generates a conversion table selection signal to select the table corresponding to the range to which the count value belongs to the address conversion table 53 and sync controller 39.

For instance, when the data which is set into the register 514 assumes $N_1$, $N_2$, and $N_3$ ($N_1>N_2>N_3$), the above ranges which are constructed by those data are set to ($N_1 \geqq$count value), ($N_2 \geqq$count value $\geqq N_1$), ($N_3 \geqq$count value $N_2$), and (count value$\geqq N_3$).

In this case, for instance, when the total number of scan lines on the display screen of the FLCD 26 is equal to 1312, if $N_1$=1000 and the count value of the counter 513 is larger than $N_1$, it is detected that the display mode which is executed by the CPU 11 is the scroll display mode. That is, in the scroll display mode, the CPU 11 accesses the video memory 41 by the address data to sequentially rewrite all of the scan lines on the display screen from the upper position one line by one. Therefore, when the result of the detection indicating that the difference of the line data to be accessed is equal to 1 successively continues 1000 times or more, it is possible to detect that the display mode is the scroll display mode. Accordingly, the comparator 515 generates the conversion table selection signal corresponding to the scroll display mode to the conversion table 53 and sync controller 39. In response to the conversion table selection signal, the sync controller 39 switches the switch $S_3$ to the side of the address counter 38. The conversion table 53 selects the conversion table to directly generate the address data which is given from the address counter 38.

Consequently, a point that the display mode which is designated by the CPU 11 on the system side is the scroll display mode can be certainly detected on the side of the FLCD interface 27. Moreover, the display which is optimum to the scroll display mode, that is, the display by the refresh driving in which the scan lines are sequentially accessed can be performed. Thus, a variation of characters or the like in the scroll display is prevented and those characters can be easily recognized.

When the count value of the counter 513 lies within a range in which the count value is equal to or less than the smallest value $N_3$, for example, it is detected that the display mode is the mode of input characters. The comparator 515, therefore, generates the conversion table selection signal according to the input character display mode to the conversion table 53 and sync controller 39. Different from the above case, the sync controller 39 alternately switches the switch S3 in a manner such that the partial rewriting operation based on the address on the FIFO side and the refreshing operation based on the address supplied through the conversion table 53 on the address counter 38 side are executed in a time-sharing manner of the ratio according to data M and N which are stored through the data bus driver 43 shown in FIG. 2. The timesharing driving mode in this instance will be explained in detail hereinafter with reference to FIG. 4.

When the count value of the counter 513 lies within a range of $N_3 \leqq$count value $\leqq N_1$, the interlace table corresponding to each range is selected as a conversion table 53. The switch $S_3$ is switched to the address counter 38 side by the sync controller 39.

As described above, the FLCD interface 27 can select the scroll display mode and another characteristic display mode in accordance with an extent of the area in the video memory 41 which is accessed by the CPU 11.

Figure 4:
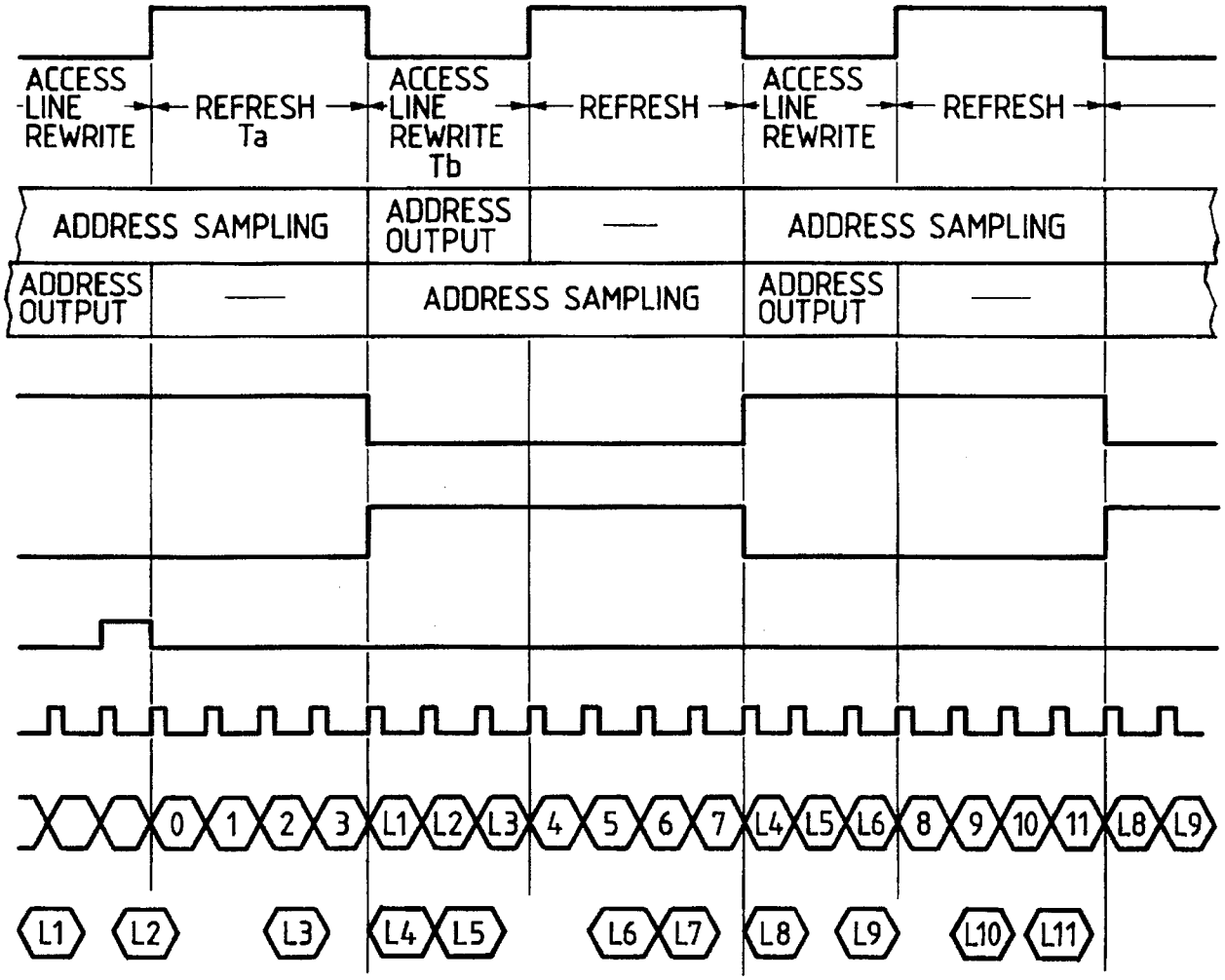
FIG. 4 is a timing chart for explaining the time-sharing driving in an FLCD interface shown in FIG. 2.

FIG. 4 is a timing chart of each signal in case of the above time-sharing driving. The fundamental operation to time-sharingly alternately execute the refreshing operation and the line rewriting operation will now be described with reference to FIG. 4.

An example in the case of executing the refreshing cycle on a 4-line unit basis and the rewriting cycle of the access line on a 3-line unit basis is shown here.

In FIG. 4, REF/$\overline{ACS}$ denotes a timing for alternately causing the refreshing cycle of the whole surface and the rewriting cycle of the access line. The "1" level indicates the refreshing cycle of the whole surface. The "0" level indicates the rewriting cycle of the access line. $T_a$ denotes a time of the refreshing cycle of the whole surface. $T_b$ indicates a time of the rewriting cycle of the access line. In the example, $T_a$:$T_b$=4:3. However, proper values are selected as $T_a$ and $T_b$ in accordance with a required refreshing rate or the like. That is, when a ratio of the value of $T_a$ is set to a large value, the refreshing rate rises. When a ratio of $T_b$ is set to a large value, a response speed of a partial change rises.

The states of the FIFO (A) 36 and FIFO (B) 37 will now be described. When the switch $S_1$ is connected to the FIFO (A) 36 side ($S_1(A/\overline{B})$="1"), the address of the line which is accessed by the CPU 11 is sampled and stored into the FIFO (A) 36. On the other hand, when the switch $S_1$ is connected to the FIFO (B) 37 side ($S_1(A/\overline{B})$="0"), the line address which is accessed by the CPU 11 is stored into the FIFO (B) 37. When the switch $S_2$ is connected to the FIFO (A) 36 side ($S_2(A/\overline{B})$="1"), the address stored in the FIFO (A) 36 is generated. When the switch $S_2$ is connected to the FIFO (B) 37 side ($S_2(A/\overline{B})$="0"), the address stored in the FIFO (B) 37 is generated.

When one refreshing operation of the whole display screen is completed and the FLCD 26 generates a vertical sync signal VSYNC or a carry occurs in the address counter 38, the count value of the address counter 38 is cleared and the line to be generated by the next refreshing cycle of the whole surface is returned to the 0th lie. The address counter 38 sequentially counts up like "1", "2", "3", . . . in accordance with the sync signal which is generated each time the sync controller 39 counts the horizontal sync signal HSYNC as mentioned above. The sync signal generated from the sync controller 39 is supplied to the sync controller 39 through the data bus driver 43 and is generated in accordance with the parameters M and N. That is, the parameters M and N are provided to decide the ratio between the refreshing cycle and the partial rewriting cycle in a predetermined period. The sync signals as many as only the number of lines of the refreshing cycle which is determined by those parameters are generated and no sync signal is generated in the partial rewriting mode. On the other hand, when the addresses of the lines $L_1$, $L_2$, and $L_3$ are accessed by the CPU 11, so long as the switch $S_1$ is connected to the FIFO (A) 36 in this instance, the addresses of the lines $L_1$, $L_2$, and $L_3$ are stored into the FIFO (A) 36. After that, when the switch $S_2$ is connected to the FIFO (A) 36, the addresses of the lines $L_1$, $L_2$, and $L_3$ are generated from the FIFO (A) 36 and $L_1$, $L_2$, and $L_3$ are selected as output lines. The switching signal of the switch $S_3$ is given as REF/$\overline{ACS}$ from the sync controller 39. In the line accessing cycle in which REF/$\overline{AC}$ is set to "0", the switch $S_3$ is switched so as to select the outputs from the FIFO (A) and FIFO (B) sides as output line addresses. In the refreshing cycle in which REF/$\overline{ACS}$ is equal to "1", the sync controller 39 switches the switch $S_3$ to the address counter 38 side. In response to the sync signal which is generated from the sync controller 39 synchronously with the horizontal sync signal HSYNC, the address counter 38 starts to sequentially count up and executes the refreshing operation from the subsequent line of the preceding cycle. In FIG. 4, for instance, after the lines $L_1$, $L_2$, and $L_3$ were generated, the lines of "4", "5", "6", and "7" subsequent to the preceding cycle are generated. In a manner similar to the above, the above operation is repeated. The reason why two FIFOs are prepared is to efficiently execute the sampling of the memory accessed address in one of the FIFOs and the generation of the sampled address from the other FIFO without any contradiction. That is, a period of time when one of the FIFOs is sampling the address corresponds to a period of time from the start of the generation of the access line stored in the other FIFO to the end of the refreshing cycle. When the refreshing cycle is finished and the rewriting cycle of the access line is started, the period of time when the other FIFO samples the address is simultaneously started.

As mentioned above, explanation has been made with respect to the case where the refreshing cycle and the line rewriting cycle are alternately repeated in the fundamental operation and, in FIG. 4, the repetitive period is set on the assumption that seven lines is set to one unit and $T_a$:$T_b$=4:3. Further, the ratio between $T_a$ and $T_b$ can be also changed in accordance with the refreshing rate or the like that is required in dependence on the environmental conditions of the temperature and the like, the kind of data to be displayed, the difference of the display device material of the FLCD, or the like.

Figure 5:
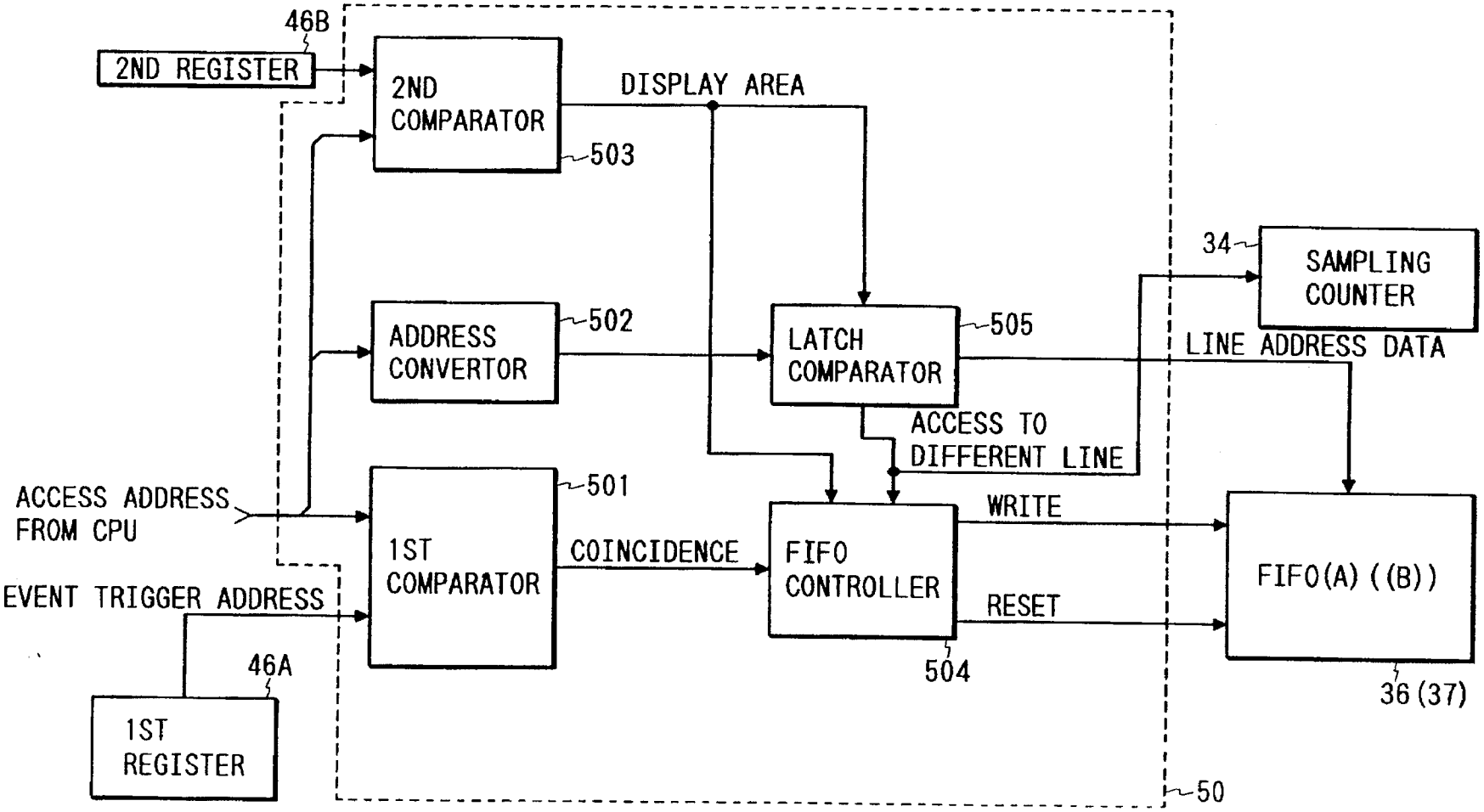
FIG. 5 is a block diagram showing a detailed construction of an access monitor circuit shown in FIG. 2.

FIG. 5 is a block diagram showing the details of the access monitor circuit 50 shown in FIG. 2.

In FIG. 5, reference numeral 501 denotes a first comparator. The first comparator 501 generates a coincidence signal when the access address given from the CPU 11 and supplied through the address bus driver 31 coincides with an event trigger address which is stored into a first register 46A. The event trigger address denotes a predetermined address which is certainly accessed by the CPU 11 when a cursor is moved.

Reference numeral 502 denotes an address converter for converting the absolute address which is accessed by the CPU 11 into the line address. That is, an address which is supplied to the access monitor circuit 50 through the address bus driver 31 is the absolute address corresponding to the VRAM on the system side and such an absolute address is converted into the line address corresponding to the display screen of the FLCD 26.

Reference numeral 503 denotes a second comparator for discriminating whether the access address of the CPU 11 belongs to the display area of the VRAM on the system side or the work area. When the access address belongs to the display area, the comparator 503 generates a signal indicative of such a discrimination result.

That is, when the CPU 11 controls the display, it accesses not only the display area of the VRAM on the system side but also the work area. Thus, the access address of the CPU which is supplied to the access monitor circuit 50 also includes the address of the work area. Therefore, the second comparator 503 compares the input address and the address stored in a second register 46B. Only when the address relates to the display area of the VRAM, the address data is written into the FIFO (A) 36 or FIFO (B) 37, as will be explained hereinlater. It is sufficient to construct the second comparator 503 so as to discriminate, for instance, whether upper two digits of the address of the VRAM are equal to or less than 10 or not. In this case, when upper two digits of the address which is supplied to the second comparator 503 are equal to or less than 10, a signal indicative of the address of the display area is generated.

Reference numeral 505 denotes a latch comparator. The latch comparator 505 receives an output signal indicating that the access address of the CPU which is given from the second comparator 503 denotes the address data of the display area and fetches the address data given from the address converter 502 and compares with the address data which has been fetched and latched in the same sampling period of time. When those address data differ, the newly fetched address data is latched and generated to the FIFO 36 (37). At the same time, a signal indicative of the access to the different line is supplied to an FIFO controller 504. Consequently, in the video memory 41, the access to the overlapped line is prevented. The signal indicative of the access to the different line is also transferred to the sampling counter 34. The sampling counter 34 counts the number of such output signals.

Reference numeral 504 denotes the FIFO controller. The FIFO controller 504 generates a reset signal in accordance with the coincidence signal from the first comparator 501 and sets a write pointer of the FIFO 36 (37) into the head of the FIFO. Consequently, the address data which is supplied into the FIFO after that is stored from the head. Upon generation, the stored address data is generated from the address data which has been supplied for the first time. The FIFO controller 504 generates a write signal to the FIFO 36 (37) in accordance with the output signal indicative of the display area which is given from the second comparator 503 and the output signal indicative of the access to the different line which is given from the latch comparator 505 and permits the writing of the address data which is supplied to the FIFO 36 (37) through the latch comparator 505.

(Second embodiment)

Figure 6:
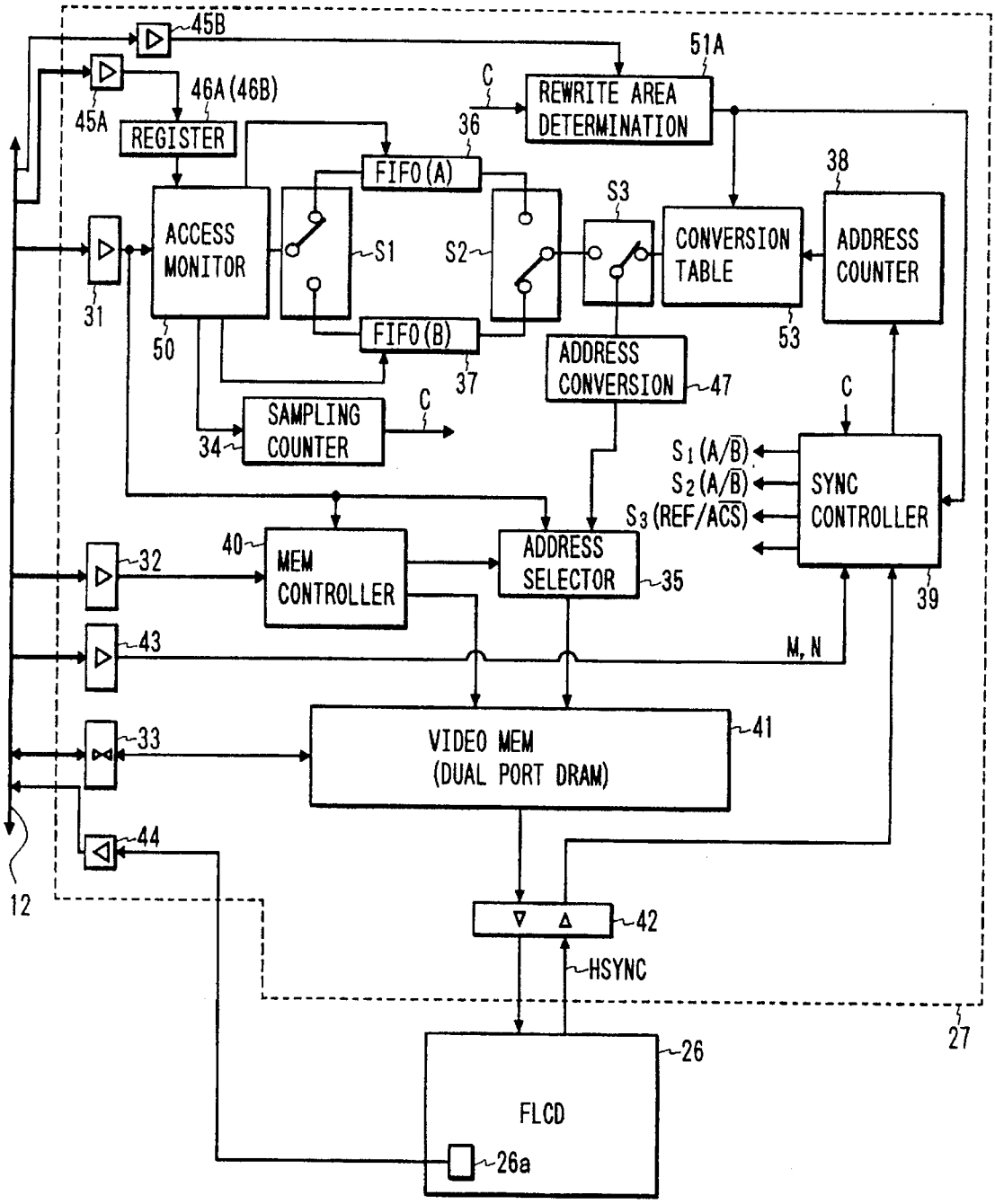
FIG. 6 is a block diagram showing a construction of an FLCD interface according to the second embodiment of the invention.

FIG. 6 is a block diagram showing a construction of the FLCD 27 according to the second embodiment of the invention. In FIG. 6, the component elements similar to those shown in FIG. 2 are designated by the same reference numerals and their descriptions are omitted.

The second embodiment differs from the above first embodiment with respect to a point that a rewrite area determination circuit 51A sets the display driving mode on the basis of the number of accessing times of the CPU 11 which is counted by the sampling counter 34.

Figure 7:
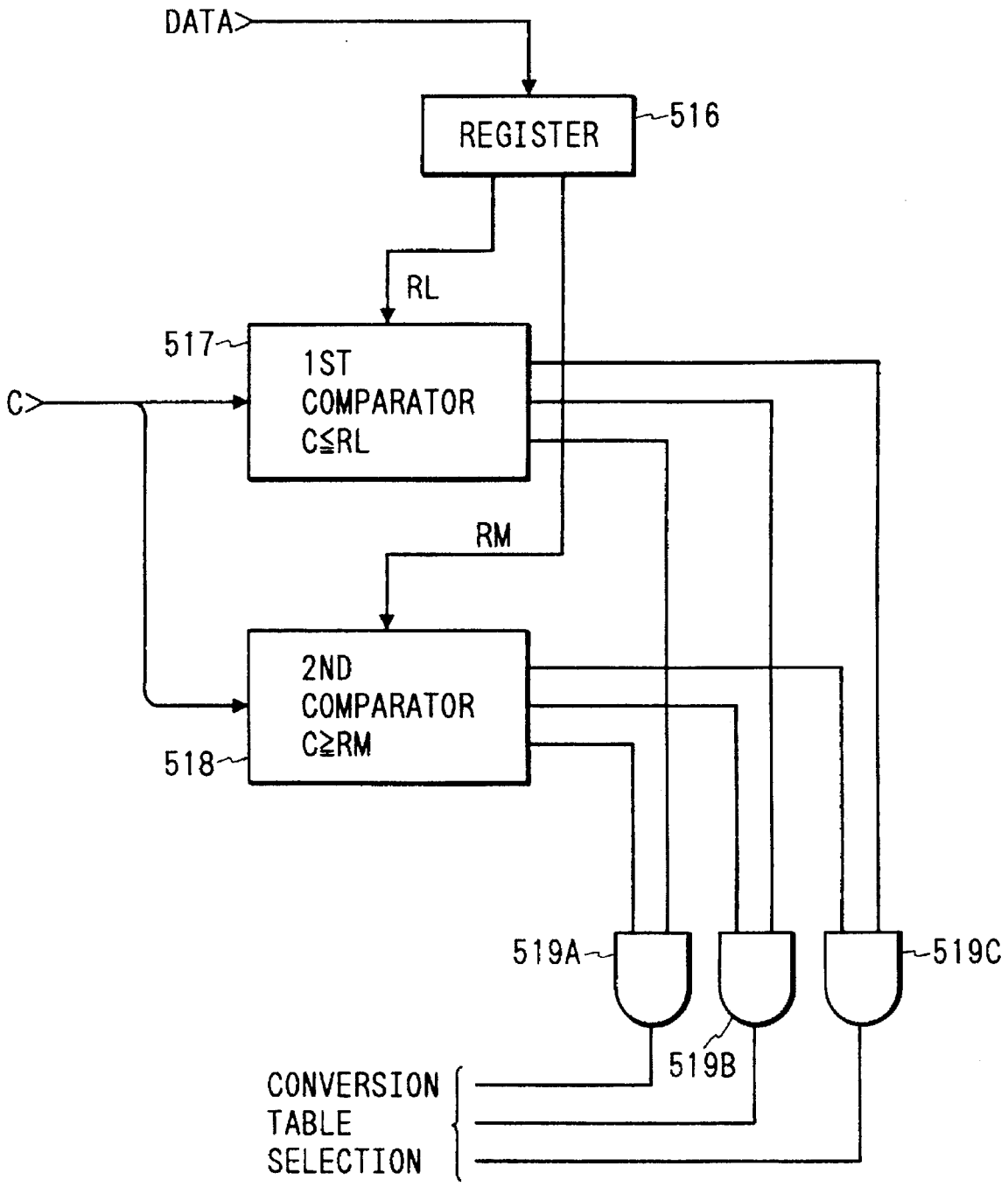
FIG. 7 is block diagram showing the details of a rewrite area determination circuit shown in FIG. 6.

FIG. 7 is a block diagram showing a detailed construction of the rewrite area determination circuit 51A shown in FIG. 6.

Count value data C counted by the sampling counter 34 in a predetermined time is supplied to a first comparator 517 and a second comparator 518. A plurality of sets of data RL and RM are stored into a register 516 through the data bus driver 45B. The data RL and RM are provided to set a range from RM as a lower limit to RL as an upper limit. A plurality of sets of RM and RL are set in correspondence to a plurality of display driving modes such as scroll, interlace, time-sharing, and the like. For instance, a plurality of sets of data (RL, RM) assume ($N_1$, $N_2$), ($N_2$, $N_3$), and ($N_3$, $N_4$). The first comparator 517 compares the data RL and the count value C. The second comparator 518 compares the data RM and the count value C. When $C \leqq RL$, the first comparator 517 generates a "1" signal. When $C \geqq RM$, the second comparator 518 generates a "1" signal. Thus, among AND gates 519A, 519B, and 519C, an output signal of the AND gate corresponding the range in which the count value C satisfies is set to "1". In accordance with the "1" output, the conversion table 53 selects the corresponding table and the sync controller 39 executes the corresponding process. The foregoing selection and processes corresponding to each of the display driving modes of the scroll, interlace, and time-sharing according to the range in which the cuont value C satisfies are similar to those in the case of the first embodiment. Therefore, their descriptions are omitted.

From the above construction, when the count value C satisfies ($N_1$, $N_2$) of a range in which the count value has a relatively large value; it is detected that the display mode which is instructed by the CPU 11 is the scroll display mode. In accordance with it, the display by the refreshing driving of the scroll, namely, non-interlace described in the first embodiment is executed.

When the count value C satisfies ($N_3$, $N_4$) of a range in which the count value has a relatively small value, the display mode is considered to be a mode in which the rewriting operation is relatively small, so that the display by the time-sharing driving of the partial rewriting and the refresh driving which has been described in the first embodiment is executed. Further, when the count value C satisfies the intermediate range ($N_2$, $N_3$), the display by the interlace mode is executed.

(Third embodiment)

Figure 8:
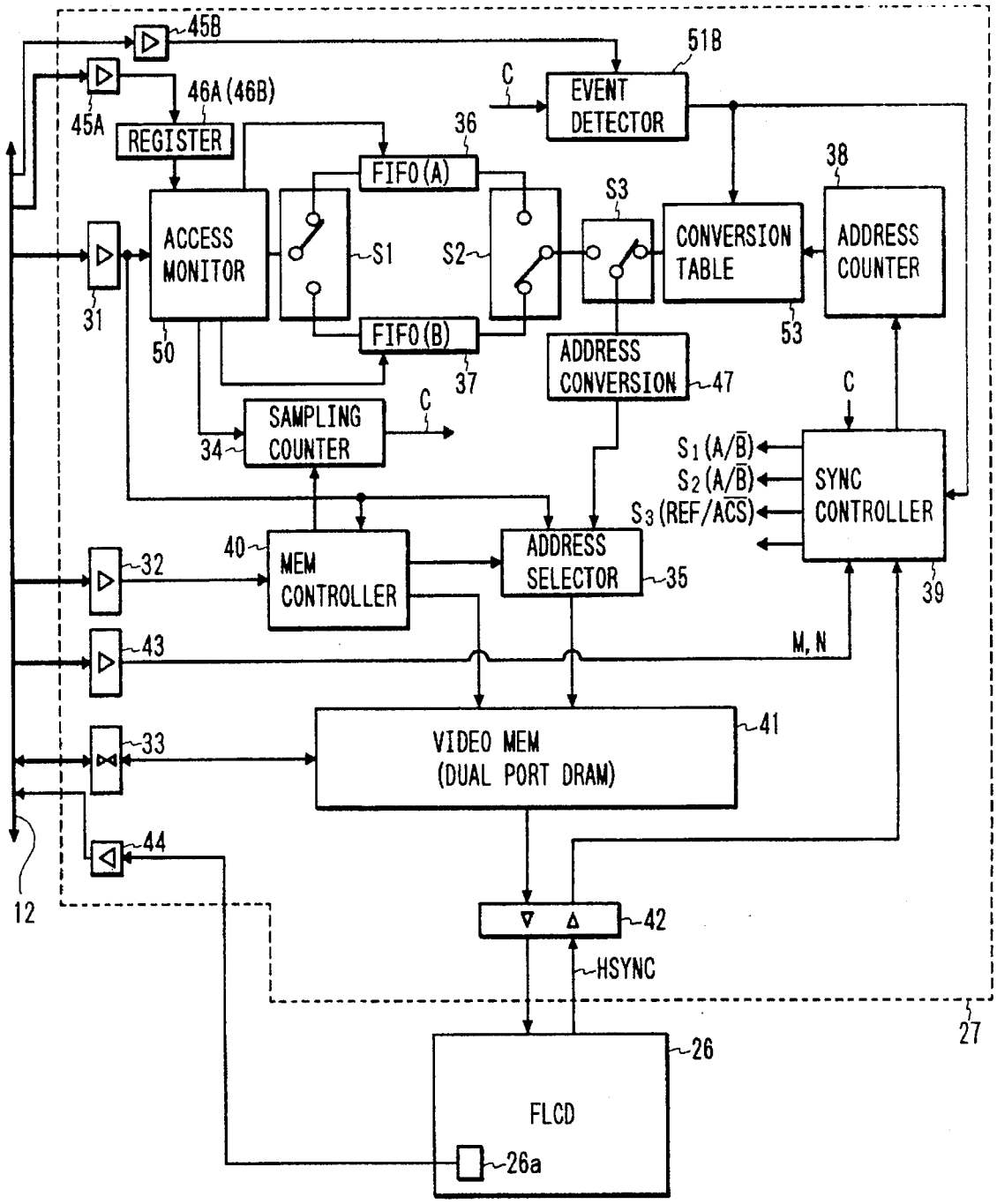
FIG. 8 is a block diagram showing a construction of an FLCD interface according to the third embodiment of the invention.

FIG. 8 is a block diagram showing a construction of the FLCD interface 27 according to the third embodiment of the invention. In FIG. 8, component elements similar to those in FIG. 6 are designated by the same reference numerals and their descriptions are omitted.

In the third embodiment, an event detector 51B detects that the display mode which is instructed by the CPU 11 is a certain special display (event) mode on the basis of the count value C of the sampling counter 34 in a predetermined time. That is, the event detector 51B compares, for instance, a plurality of data stored in a register in correspondence to a plurality of events and the count value C by a comparator. When they coincide, the event detector 51B detects the event corresponding to the coincident data. A detection signal indicative of such a result is supplied to the address conversion table 53 and sync controller 39 and a proper display according to the detected event is performed.

Figure 9:
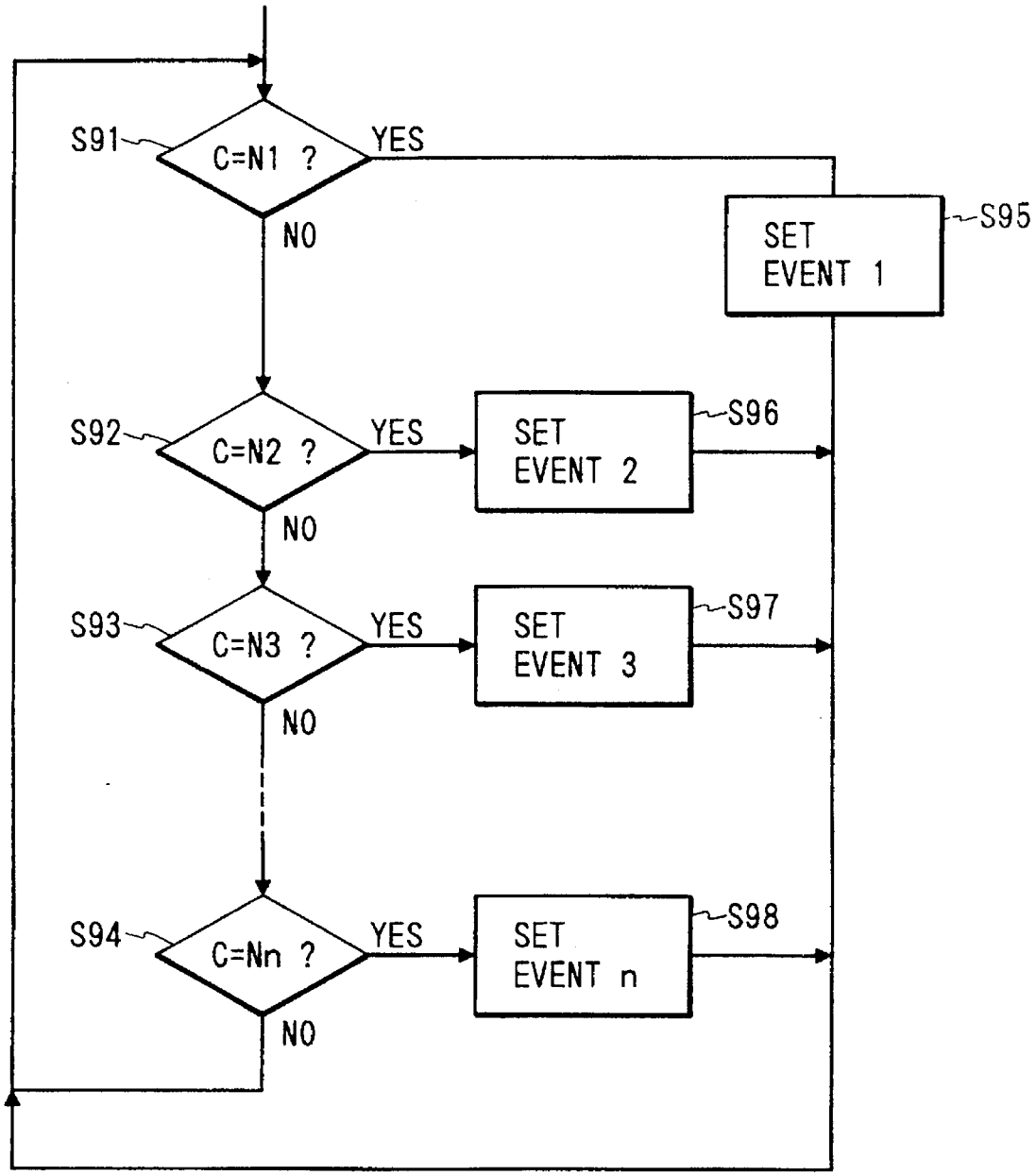
FIG. 9 is a flowchart showing the operation of an event detection circuit shown in FIG. 8.

FIG. 9 is a flowchart showing the operation in the event detector 51B. That is, data $N_1$, $N_2$, $N_3$, . . . , $N_n$ set in the register are sequentially compared with the count value C in steps S91, S92, S93 . . . , S94. When they coincide, the detected event is set in each of steps S95, S96, S97 . . . , and S98. Namely, a signal indicating that the relevant event has been detected is generated to the address conversion table 53 and sync controller 39.

As data which is set into the register in the event detector 51B, for instance, when a relatively larger value as compared with the total number of scan lines of the display screen is set, the scroll display is detected as an event. On the contrary, when the line number which is relatively small value and corresponds to the height of character is set as data, the display of the input character is detected. The optimum display driving mode according to the detected events is selected.

(Fourth embodiment)

Figure 10:
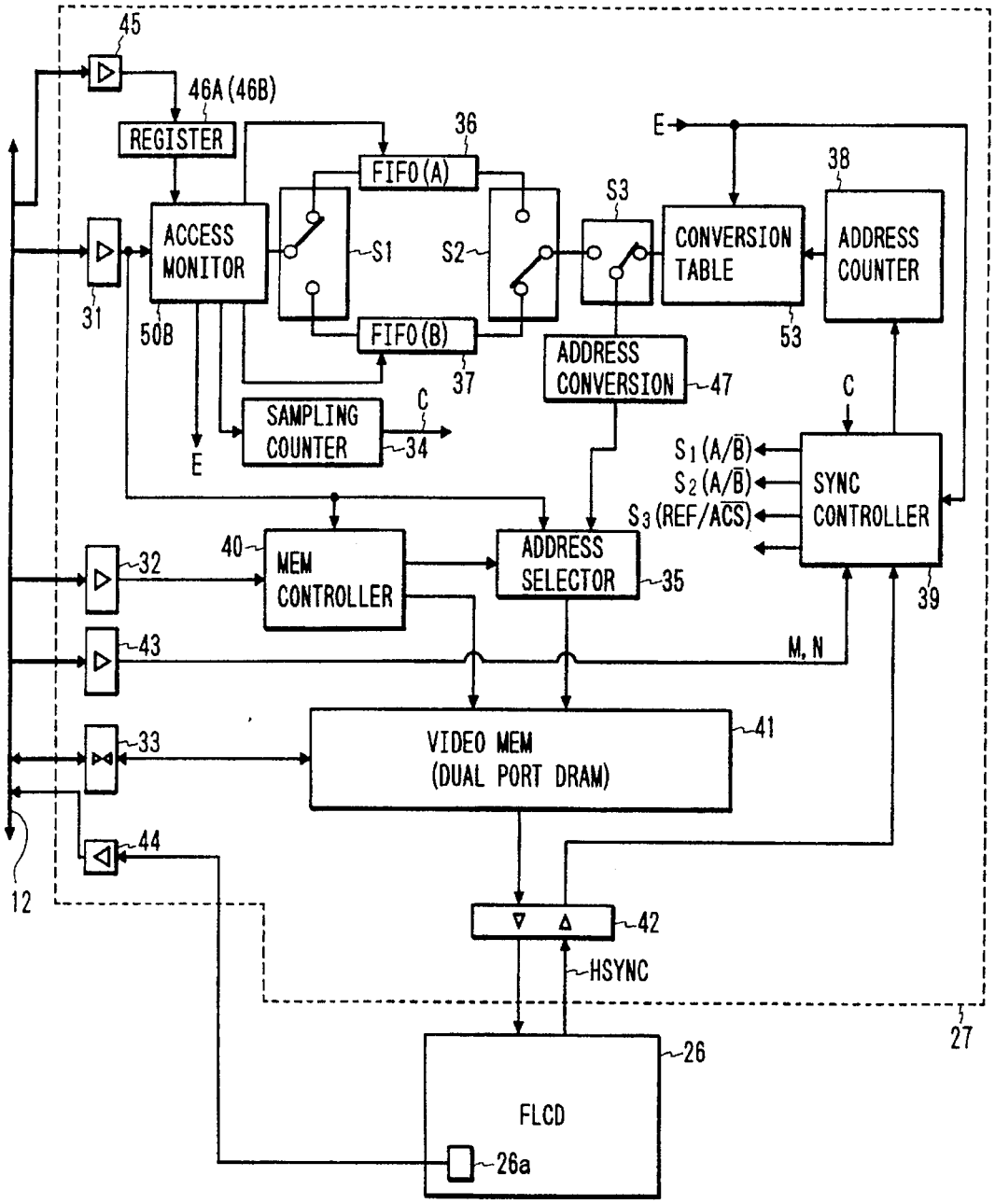
FIG. 10 is a block diagram showing a construction of an FLCD interface according to the fourth embodiment of the invention.

FIG. 10 is a block diagram showing a construction of the FLCD interface 27 according to the fourth embodiment of the invention. Component elements similar to those shown in FIG. 6 are designated by the same reference numerals and their descriptions are omitted here.

In the fourth embodiment, in a manner similar to FIG. 1, the absolute address data when the video RAM on the system side is accessed by the CPU 11 in order to rewrite the display content or the like is given to an access monitor circuit 50B through the address bus driver 31. The absolute address (data) supplied to the access monitor circuit 50B is converted into the line address (data) corresponding to the scan line on the display screen and is selectively written into the FIFO (A) 36 or FIFO (B) 37 in accordance with the write signal which is supplied from the access monitor circuit 50B.

As will be explained in detail by using FIG. 11, the access monitor circuit 50B generates an icon detection signal E when address data of a preset icon coincides with the address data which is accessed by the CPU 11. The icon detection signal is supplied to the conversion table 53.

The address conversion table 53 has a table to directly generate the address data which is supplied from the address counter 38 and a plurality of interlace tables to convert those data into the addresses such as to be displayed in the interlace mode. One of those tables is selected in accordance with the icon detection signal E from the access monitor circuit 50B.

As address data to access the video memory 41 in order to display as mentioned above, the address data to refresh the whole screen of the FLCD 26 and the address data to partially rewrite the lines accessed by the CPU 11 in order to change the display content are time-sharingly generated in accordance with the switching of the switch $S_3$ in principle. In addition to the addresses for the partial rewriting and refreshing, an address of the interlace mode suitable for a predetermined display state can be set by the icon detection signal E from the access monitor circuit 50B.

Figure 11:
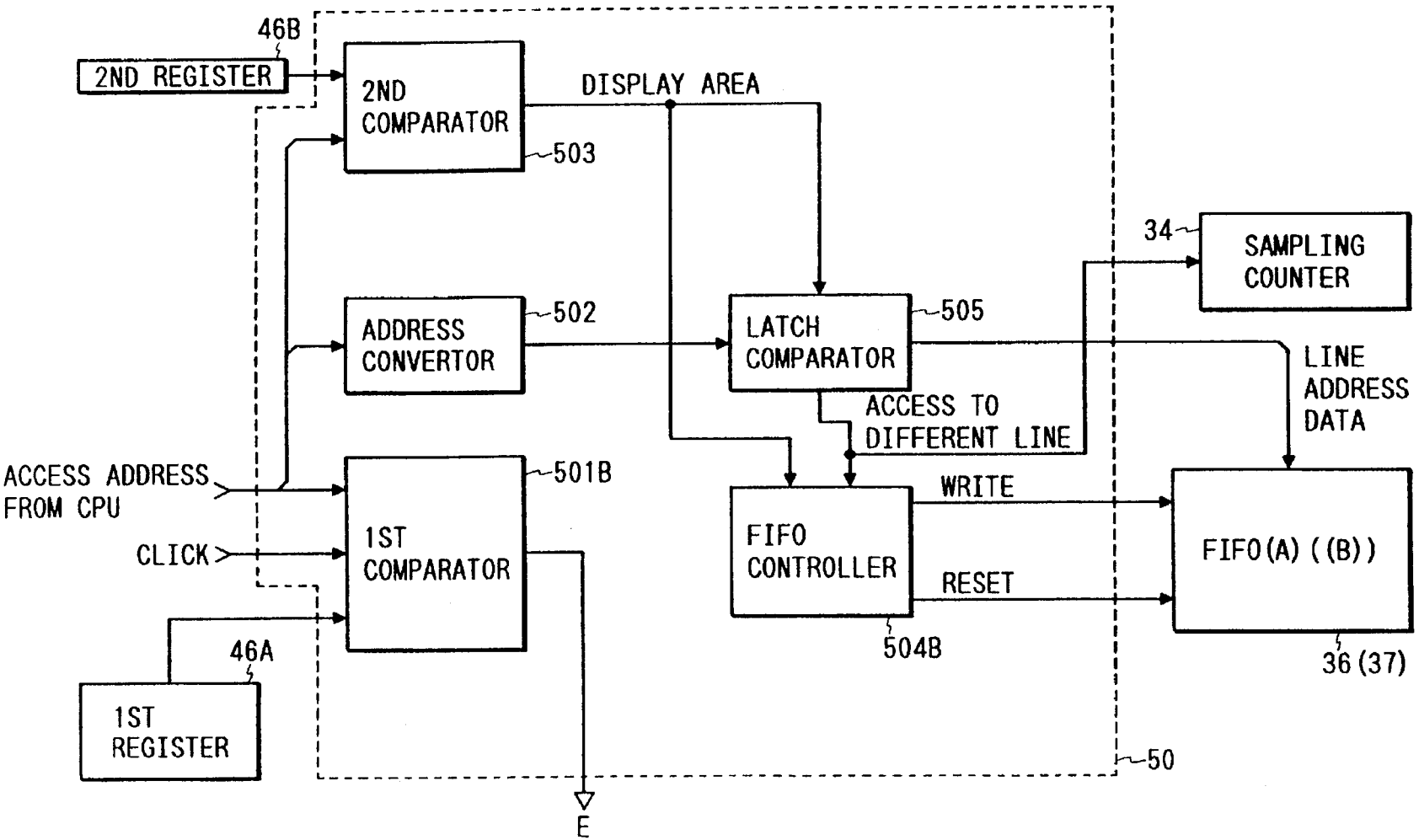
FIG. 11 is a block diagram showing the details of an access monitor circuit shown in FIG. 10.

FIG. 11 is a block diagram showing the details of the access monitor circuit 50B shown in FIG. 10. In FIG. 11, component elements similar to those shown in FIG. 5 are designated by the same reference numerals and their descriptions are omitted here.

Figure 12:
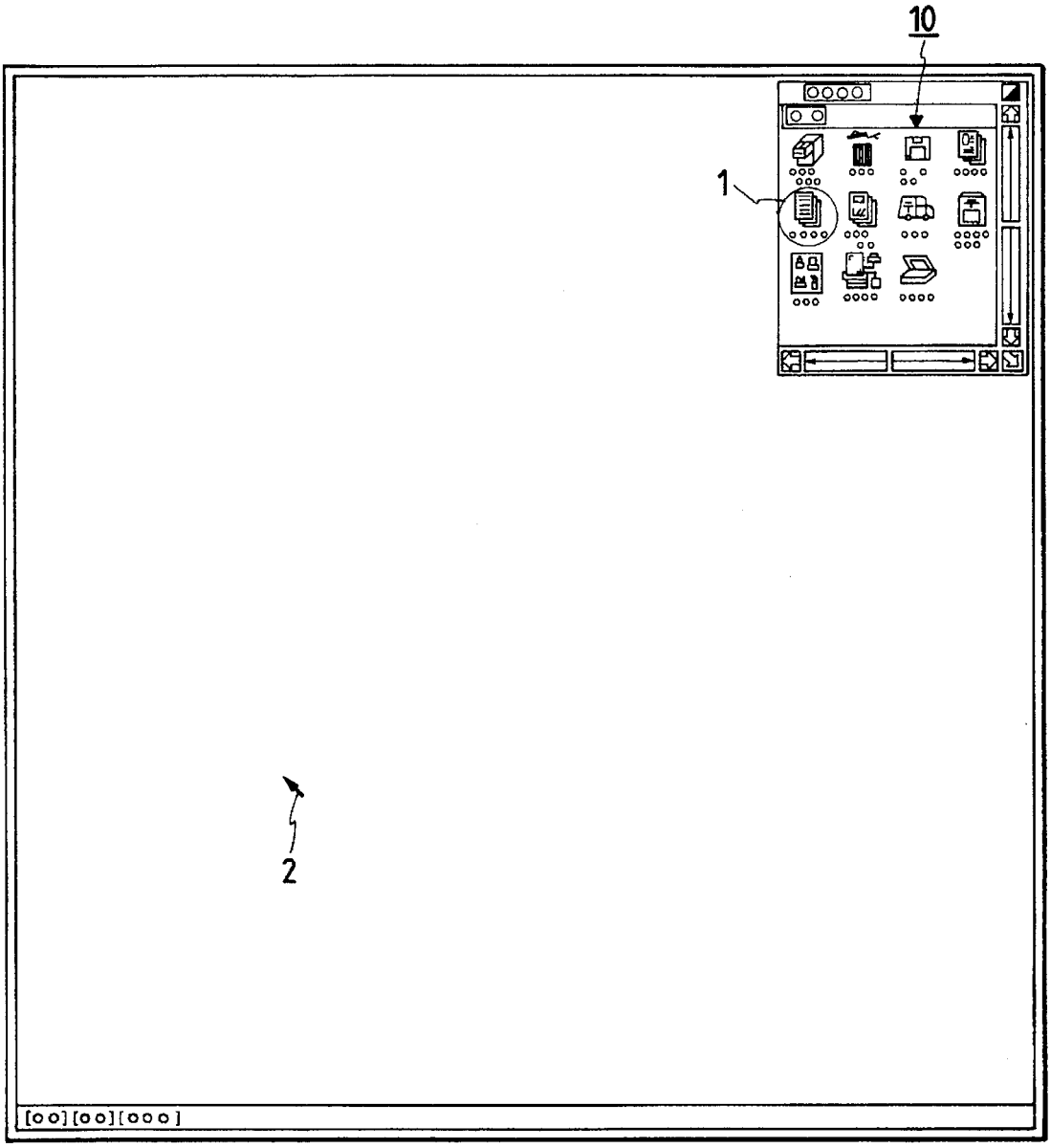
FIG. 12 is a front view of a display screen showing a display example of the FLCD according to the fourth embodiment.

In FIG. 11, reference numeral 501B denotes a first comparator. When the access address of the CPU 11 which is supplied through the address bus driver 31 coincides with a plurality of kinds of icon addresses which are stored into the first register 46A, the first comparator 501B generates the icon detection signal E. The icon address denotes a predetermined address which is certainly accessed by the CPU 11 upon selection of the icon. That is, each address of a plurality of icons 10 which are displayed on the display screen of the FLCD 26 as shown in FIG. 12 has been stored in the first register 46A. A program to execute each iron has been stored in the main memory 13 or the hard disc device 18.

Figure 13:
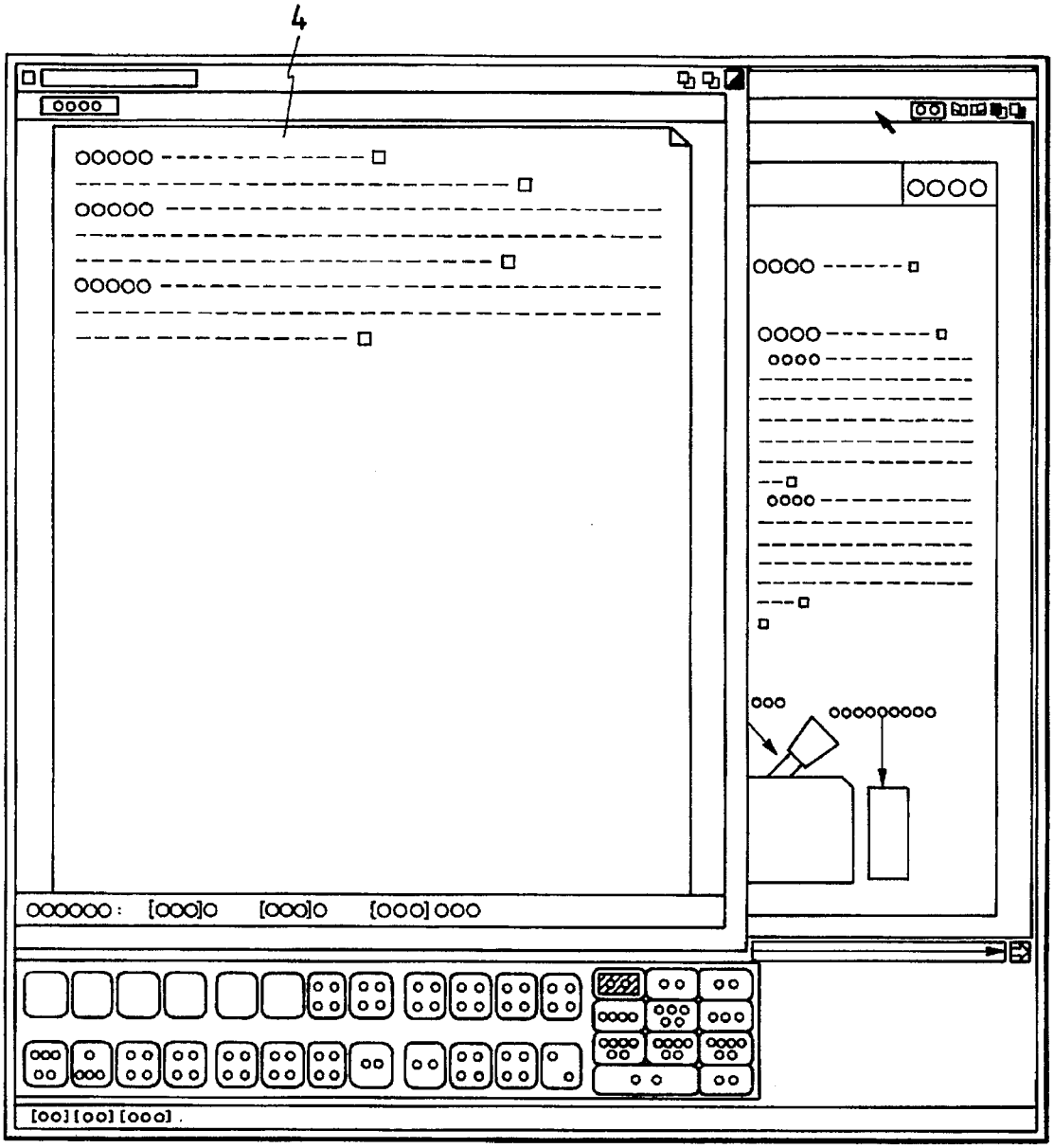
FIG. 13 is a front view of the display screen showing a display example of the FLCD according to the fourth embodiment.

When a cursor 2 is moved and, for example, the icon 1 of "input paper" is designated by the cursor 2 and is selected by a click of a mouse or the like, the first comparator 501B generates the icon detection signal E corresponding to the icon 1. The icon detection signal E is supplied to the conversion table 53 and the conversion table which is optimum to the icon 1 of "input paper" is selected. Practically speaking, when the icon of "input paper" is selected, spaces 4 to input characters or the like as shown in FIG. 13 are displayed on the display screen of the FLCD 26. The characters or the like which have been inputted by the key operation of the operator are sequentially displayed in the space 4. Therefore, as display changing modes which can be considered in case of the display of "input paper", there are the display mode of characters or the like according to the depression of keys, cursor moving mode, scrolling mode, ad the like. Therefore, as a display driving mode which is suitable for each of the display changing modes, the table of the non-interlace mode (the scan lines are sequentially driven without thinning out the lines: that is, refresh driving. In the embodiment, such a non-interlace mode is considered as one of the interlace modes) is selected. Consequently, improper display of characters or the like due to the scroll or the like is prevented in particular and even in the scroll, the characters or the like can be certainly recognized.

In the display mode of "input paper", when the display is relatively fastly changed, for instance, when the cursor is moved, the display of the cursor movement is compensated by the line rewriting operation which has been described in detail by using FIG. 4 and the proper display is performed due to this. Therefore, no problem occurs even when the non-interlace (refreshing) mode is set as a display driving mode in the "input paper" mode.

When the icon of "figure" is set as another example of the selection of the interlace mode according to the setting of the icon, for example, a 4-interlace mode as will be explained by using FIG. 19 is selected.

An FIFO controller 504B generates the write signal to the FIFO memory 36 (37) in accordance with the output indicative of the display area which is given from the comparator 503 and the output indicative of the access to the different line which is given from the latch comparator 505, thereby permitting the writing of the address data which is supplied into the FIFO 36 (37) through the latch comparator 505.

(Fifth embodiment)

Figure 14:
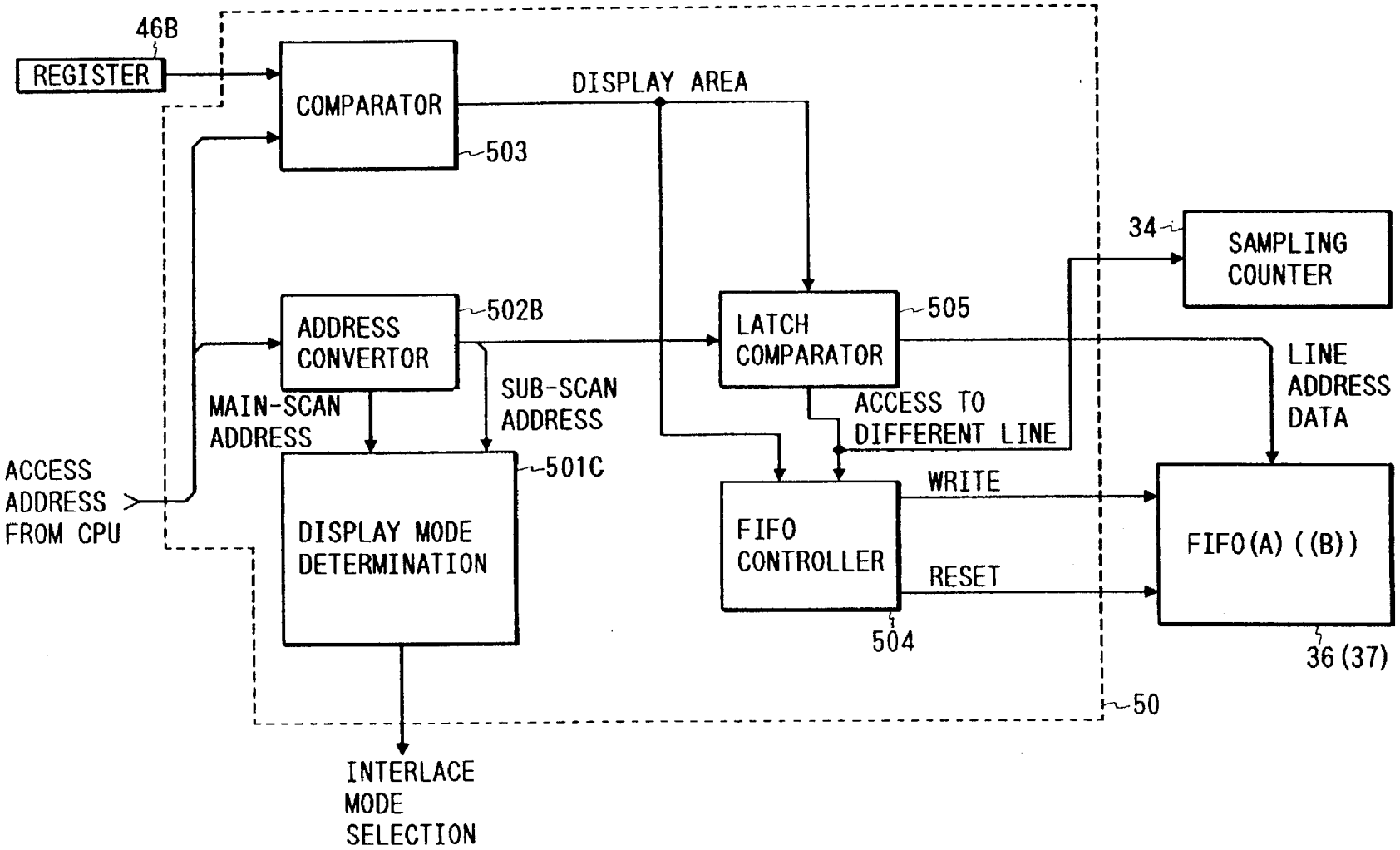
FIG. 14 is a block diagram showing the details of an access monitor circuit according to the fifth embodiment of the invention.

FIG. 14 is a block diagram showing a construction according to the fifth embodiment of the invention of the access monitor circuit 50B shown in FIG. 11. In FIG. 14, component elements similar to those shown in FIG. 11 are designated by the same reference numerals and their detailed descriptions are omitted here.

In FIG. 14, an address converter 502B converts the absolute address into the main-scan address and sub-scan address (namely, line addresses mentioned above) indicative of the positions in the main-scan direction (X direction) and sub-scan direction (Y direction) on the display screen. The main-scan address and sub-scan address are supplied to a display mode determination circuit 510C. On the basis of those addresses, the display mode determination circuit 510C generates an interlace mode selection signal. The interlace mode selection signal is supplied to the conversion table 53 shown in FIG. 10. The conversion table 53 selects the optimum interlace table in accordance with the above signal.

Figure 15:
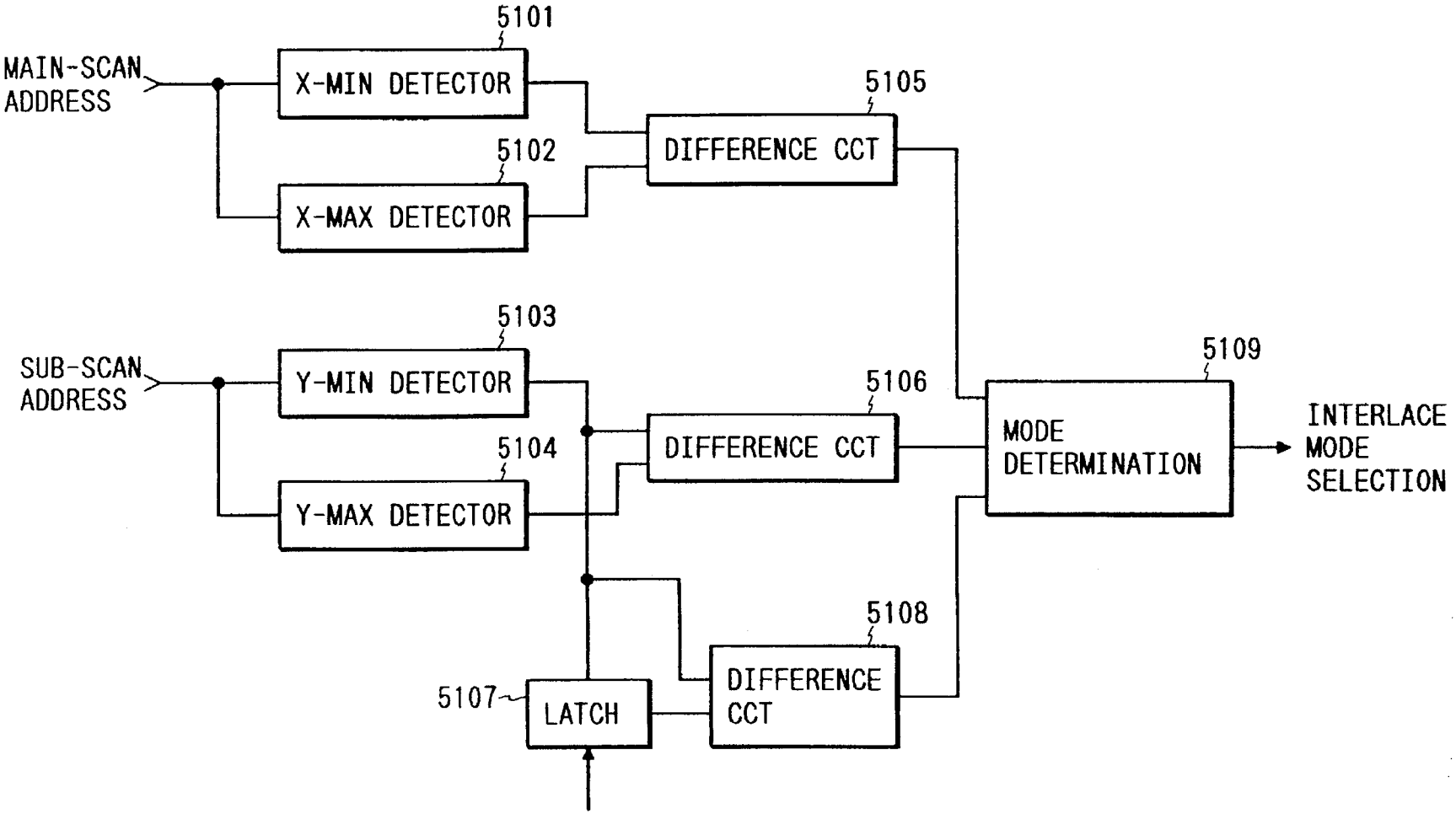
FIG. 15 is a block diagram showing the details of a display mode determination circuit shown in FIG. 14.

FIG. 15 is a block diagram showing the details of the display mode determination circuit 510C.

An X direction Min detector (X-MIN detector) 5101 detects the minimum value of the main scan addresses which are continuously given. An X direction Max detector (X-MAX detector) 5102 detects the maximum value of those main scan addresses. A difference between the minimum and maximum values is calculated by a difference circuit 5105 and sent to a mode determination circuit 5109. A difference between the minimum and maximum values of the continuous sub-scan addresses is also similarly calculated by a Y direction Min detector (Y-MIN detector) 5103, a Y direction Max detector (Y-MAX detector) 5104, and a difference circuit 5106 and is sent to the mode determination circuit 5109.

The difference between the minimum and maximum values of each of the main-scan addresses and sub-scan addresses indicates a width of each address which is continuously given. A shape or size to be displayed is detected from such a difference. The mode determination circuit 5109 has a table to generate a signal to select the interlace mode in accordance with the shape or the like and generates the interlace mode signal on the basis of such a table. Thus, the conversion table 53 (FIG. 10) selects the table of the interlace mode according to the shape or the like. For example, as the shape is relatively large, the interlace mode in which the number of lines to be thinned out is large is selected.

The minimum value of the sub-scan addresses which is detected by the Y-MIN detector 5103 is supplied to a latch 5107 and a difference circuit 5108. The minimum value supplied to the latch 5107 is transferred to the difference circuit 5108 after the elapse of a predetermined time. The difference circuit 5108 calculates the difference between the above two minimum values and transmits the difference to the mode determination circuit 5109. The difference which is generated from the difference circuit 5108 indicates the minimum value of the sub-scan addresses per predetermined time, that is, it indicates a movement amount (moving speed) of the shape or the like which is displayed.

As described above, the mode determination circuit 5109 generates the interlace mode selection signal according to the size of shape which is displayed or the like or a movement amount of the shape to the conversion table 53. The conversion table 53 selects the proper interlace table according to the selection signal. For example, as mentioned above, as the size of shape or the movement amount thereof is large, the interlace table in which the number of lines to be thinned out is large is selected.

(Sixth embodiment)

The above fourth and fifth embodiments have been described with respect to the construction in which the display driving is executed in the optimum interlace mode according to the selected icon or the size or movement amount of the shape displayed. The sixth embodiment will now be explained with respect to a construction in which the operator can arbitrarily select a desired interlace mode.

Figure 16:
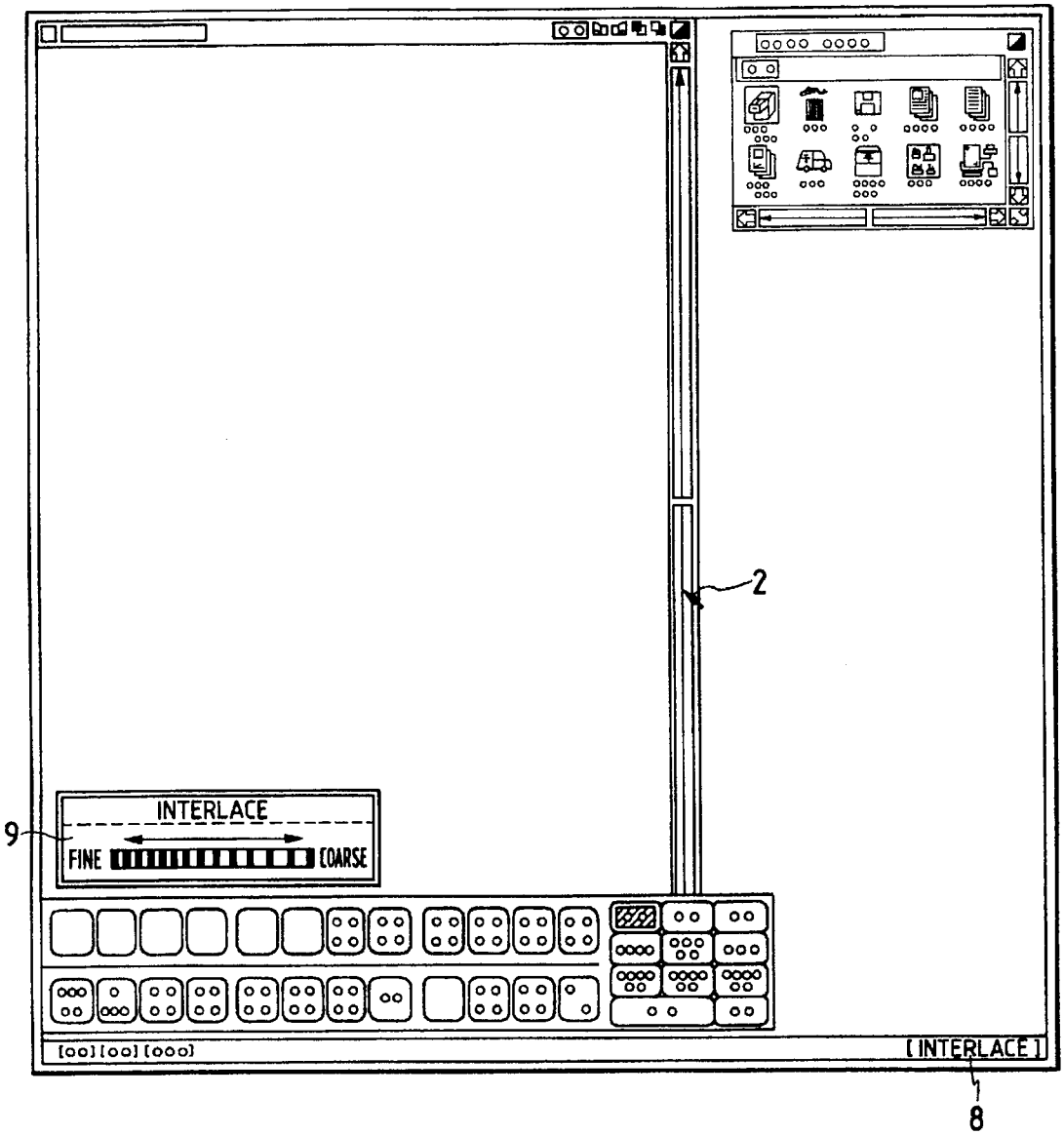
FIG. 16 is a front view of a display screen showing a display example according to the sixth embodiment of the invention.

FIG. 16 is a diagram showing an example of the display on the display screen of the FLCD 26 according to the sixth embodiment. The diagram shows a menu screen. When the operator moves the cursor 2 to an icon 8 of "interlace" and clicks, a sub-window 9 to set the interlace mode is displayed. The operator moves the cursor 2 to the display portion of the sub-window and can arbitrarily set a proper interlace within a range from the interlace in which the number of lines to be thinned out is fine to the interlace in which the number of lines to be thinned out is coarse.

Figure 17:
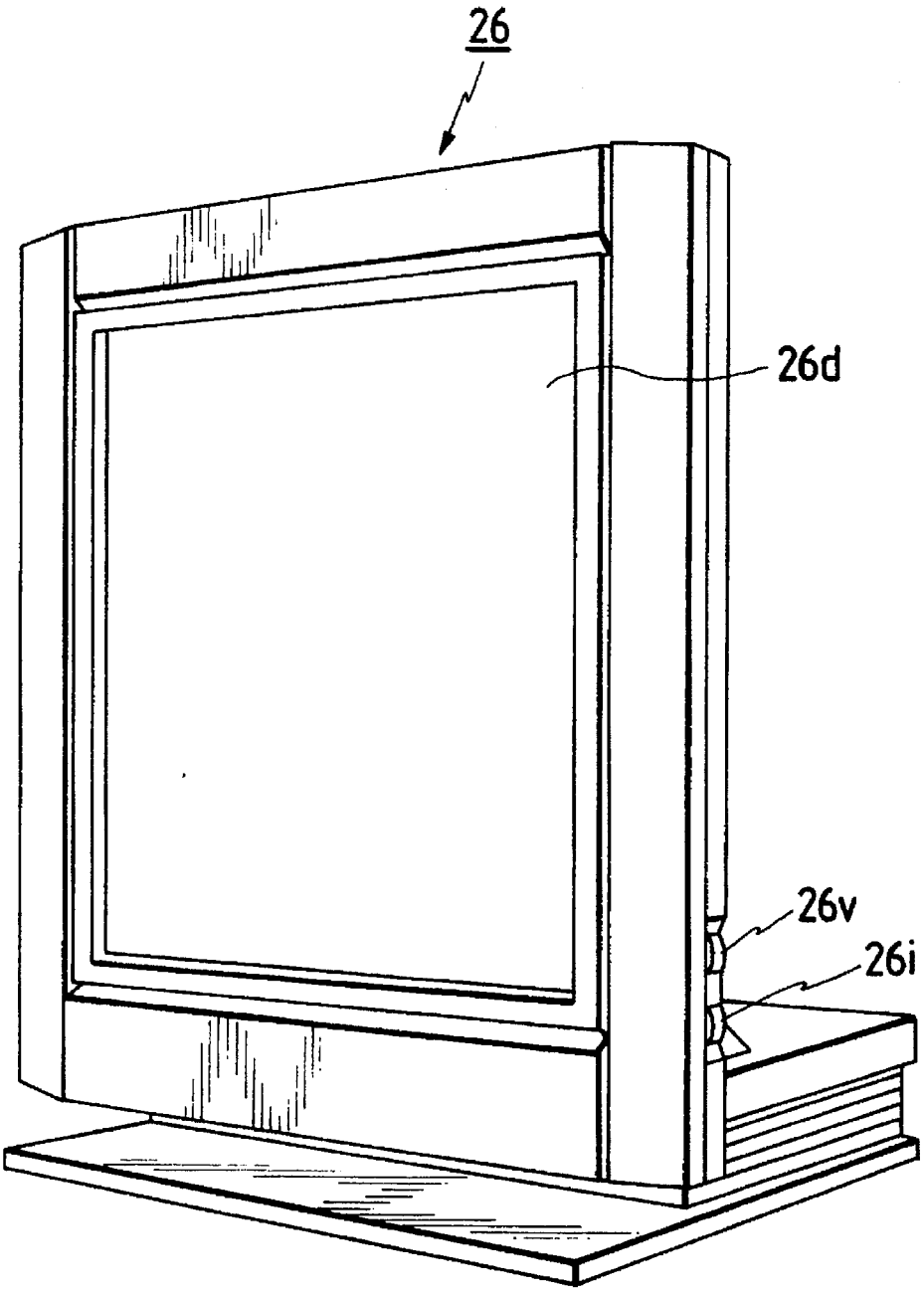
FIG. 17 is an external perspective view of an FLCD according to the sixth embodiment of the invention.

FIG. 17 is an external perspective view of the FLCD 26 according to another construction in which the operator arbitrarily sets the interlace mode.

A knob **26*i* to set the interlace mode is provided in parallel with a knob 26*v* for a luminance volume in the lower side portion of an apparatus frame around the display screen 26*d*. By operating the knob 26*i***, the operator can select a desired interlace mode in a range from the interface in which the number of lines to be thinned out is fine to the interlace in which it is coarse.

Figure 18:
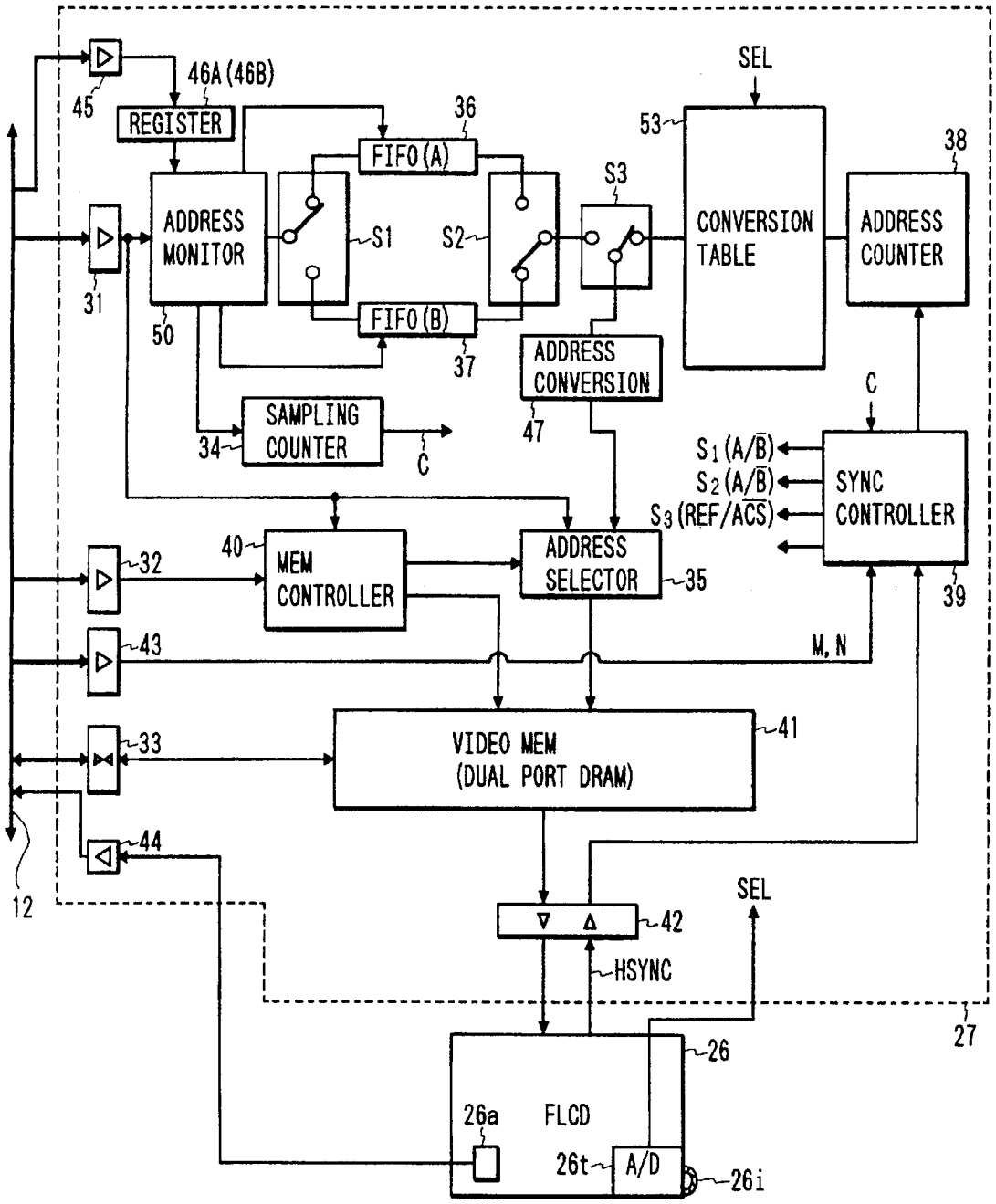
FIG. 18 is a block diagram of an FLCD interface of the sixth embodiment shown in FIG. 17.

FIG. 18 is a block diagram showing the FLCD interface 27 according to the construction to set the interlace which has been described in FIG. 17. In FIG. 18, component element similar to those shown in FIG. 10 are designated by the same reference numerals and their descriptions are omitted here.

As shown in FIG. 18, an operation amount of the knob **26*i* is converted from an analog signal into a digital signal by an A/D converter 26*t* and is supplied as a selection signal SEL to the conversion table 53. The conversion table 53** selects the interlace table corresponding to the selection signal SEL.

In the above sixth embodiment, the interlace mode to be selected is made different in dependence on the number of lines to be thinned out. It is also possible to select the interlace mode in which the number of lines to be thinned out changes at random or the interlace mode in which the lines are sequentially driven one line by one in the block of a predetermined number of lines and the lines among the blocks are thinned out.

FIGS. 19 and 20 are explanatory diagrams showing examples of the interlace tables in the conversion table 53 in each of the foregoing embodiments. The address data of the lines to be accessed on the display screen in accordance with each of the addresses 0 to N which are generated the address counter 38 has been stored in each table shown in FIG. 19. For example, in the table corresponding to the 32-interlace mode, the address data of the first line has been stored in the address 0, the address data of the 33rd line has been stored in the address 1, . . . , and the address data of the second line has been stored into the address k. Due to this, in the case where such a table is used for conversion, the lines of the address data to be stored are sequentially driven every 31 other lines from the address 0 to the address N in accordance with this order.

For instance, as described in the fifth embodiment, in the case where the shape displayed is a figure such as "circle" or the like, the 8-interlace mode is selected.

The address data of the lines to be accessed on the display screen has been stored in the conversion tables shown in FIG. 20 in accordance with each of the addresses 0 to k which are generated by the address counter 38. For instance, in the table of the 10–32 interlace mode on the leftmost side in the diagram, the address data of the first line, second line, . . . , tenth line, 321st line, 322nd line, . . . , and 330th line have been stored in the addresses 0, 1, . . . , 9, 10, 11, . . . , and 19, respectively. That is, first, the lines of the first to tenth lines from the top position of the display screen are sequentially driven. Subsequently, the 321st to 330th lines which are away from the first to tenth driven lines by the 310 (10 lines×31 (32 interlaces)) lines are sequentially driven. When the lines of the whole display screen have been driven in a manner similar to the above, the above operations are repeated.

In the conversion table 53, in addition to the interlace tables shown in FIGS. 19 and 20, the interlace table in which the number of lines to be thinned out changes at random and the table of what is called a non-interlace (refresh driving) in which the number of lines to be thinned out is equal to 0 have been stored as interlace tables. As shown in the above embodiments, those tables are selected in accordance with the icon, display shape, or the operation input by the operator.

(Seventh embodiment)

Figure 21:
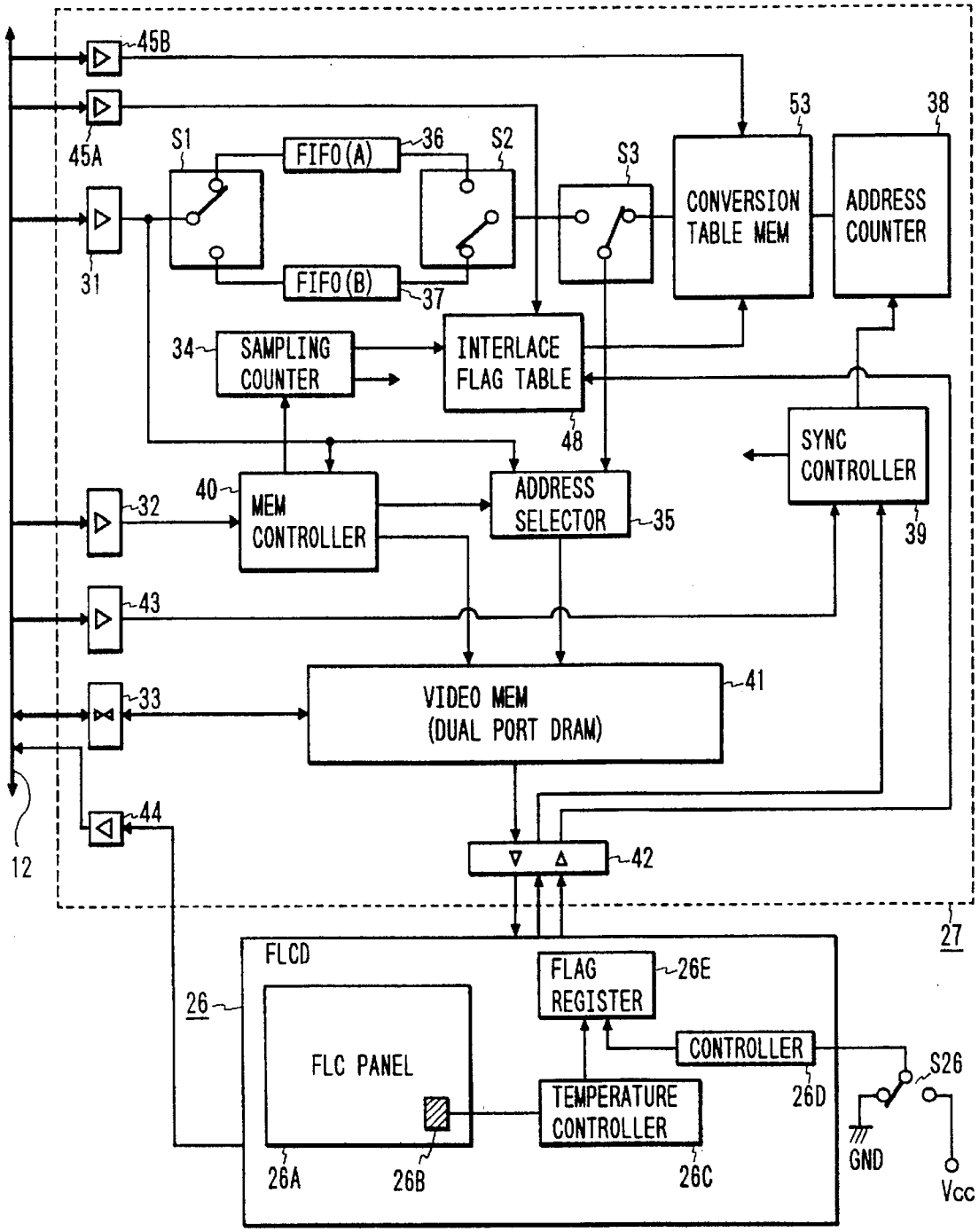
FIG. 21 is a block diagram showing a construction of an FLCD interface according to the seventh embodiment of the invention.

FIG. 21 is a block diagram showing a construction of the FLCD interface 27 according to the seventh embodiment of the invention. In FIG. 21, component elements similar to those shown in FIG. 2 are designated by the same reference numerals and their descriptions are omitted here.

In the diagram, the address data when the CPU 11 accesses the video memory 41 to rewrite the display content is supplied to the memory controller 40 through the address bus driver 31 and to one input terminal of the address selector 35. The address data is also selectively given to the FIFO (A) 36 or FIFO (B) 37 and stored in accordance with the switching of the first switch $S_1$.

The control signal from the CPU 11 is supplied to the memory controller 40 through the control bus driver 32. The memory controller 40 controls the sampling counter 34, address selector 35, and video memory 41 in response to the control signal. That is, when the CPU 11 discriminates the address data to access the memory 41 for a predetermined time and the different address is accessed, the memory controller 40 generates only such address data to the sampling counter 34. The counter 34 counts the number of supplied address data. The count value is given to the sync controller 39 and an interlace flag table memory 48 and is used to decide the ratio between the partial rewriting cycle and the refresh driving cycle or the like or to determine the interlace mode.

The interlace flag table memory 48 selects one of the tables on the basis of the count value of the sampling counter 34 and information of a temperature sensor 26B in an FLC panel 26A, which will be explained hereinlater. The content of the selected table is supplied to the address conversion table memory 53 and the proper conversion table is selected. The information of the interlace flag table can be rewritten by supplying the content of the table through a data bus driver 45A.

The temperature sensor 26B is provided for the FLC panel 26A of the FLCD 26 in order to detect a temperature of the FLC panel. A temperature controller 26C controls the temperature of the FLC panel 26A using a heater or the like on the basis of the temperature detected by the temperature sensor 26B. On the basis of the detected temperature, the temperature controller 26C sets a flag value into a flag register 26E with reference to a table which is provided in the temperature controller 26 itself and will be explained hereinlater by using FIG. 24. In this instance, a controller 26D to control the FLCD 26 switches the above temperature table to be referred in accordance with a state of a temperature table change-over switch 26S which is provided on, for instance, an outside casing of the FLCD 26 and can be operated by the user. By providing a plurality of tables in accordance with the switching state, a temperature threshold value to the flag value can be changed, so that the number of flags can be reduced. A hardware construction can be consequently simplified. It is also possible to provide a volume in place of the above switch and to provide a plurality of temperature tables in accordance with the value of the volume.

In the above construction, when the CPU 11 changes the display content, the address data which is accessed by the CPU 11 is stored into the FIFO (A) 36 or FIFO (B) 37 through the address bus driver 31 by the selection of the switch $S_1$. After that, the display is executed in a manner similar to that described by using FIG. 2.

In the seventh embodiment, further, the refreshing cycle is performed in what is called an interlace mode in order to obtain the optimum picture quality by preventing or adjusting a flickering on the display screen or an improper display of the image. The interlace mode is changed in accordance with the temperature of the FLC panel and the number of lines accessed from the CPU 11. The refreshing cycle operation in the interlace mode according to the seventh embodiment will now be described hereinbelow.

FIG. 22 is a schematic diagram showing the details of the address conversion tables in the memory 53 shown in FIG. 21. Four conversion tables are provided in the memory 53 as shown in FIG. 22. Those tables are selected in accordance with the interlace flag information set in the interlace flag table in the memory 48.

FIG. 23 shows an example of the contents of the interlace flag table which is developed in the memory 48. One of the information regarding the interlace flag is selected on the basis of combinations of the temperature flag information "00", "01", "10", and "11" set in the temperature flag register 26E and the number of lines accessed from the CPU 11 which has been set in the sampling counter 38. One of the four conversion tables in the address conversion table 53 is selected on the basis of the selected interlace flag information.

The address data of the line to be accessed on the display screen in accordance with each of the addresses 0 to N which are generated from the address counter 38 has been stored in each of the conversion tables in the address conversion table 53. For instance, the table corresponding to the interlace flag "00" is the table corresponding to the 32 interlace mode. In this table, the address data of the first line has been stored in the address 0, the address data of the 33rd line has been stored in the address 1, . . . , and the address data of the second line has been stored in the address k. Therefore, when such a table is selected, the lines of the address data to be stored are sequentially driven every 31 other lines from the address 0 to the address N in accordance with this order. The storage pattern of the address data, namely, the interlace mode (line access pattern in the refreshing cycle) in the refreshing operation has different tendencies in each table in correspondence to the temperature flag information that is set in accordance with the temperature of FLC panel 26A and to the number of lines accessed from the CPU 11. For instance, when the temperature of FLC panel 26A is relatively low and the number of lines accessed from the CPU 11 is small, the table having a tendency such that a skipping degree of the addresses which are generated in association with that the address from the address counter 38 is increased from 0 to N is relatively large is selected. Due to this, when the temperature of FLC panel is low, a feature of the FLC such that the response speed for the driving signal becomes slow can be compensated. A refresh cycle period which seems to be constant can be assured. Thus, the occurrence of a flickering of the display screen under the low temperature environment can be prevented in particular.

On the contrary, when the number of lines accessed from the CPU 11 is large, the table having a tendency such that a skipping degree of the addresses which are generated in association with that the address from the address counter 38 is increased from 0 to N is relatively small irrespective of the temperature of FLC panel 26A is selected. Due to this, since the contents of the whole display screen are rewritten every addresses of a small skipping degree, the updating of the display without a feeling of physical disorder can be executed.

FIG. 24 is a conceptional diagram showing temperature flag tables which the temperature controller 26C shown in FIG. 21 has. As will be obviously understood from the diagram, either one of four kinds of flags each consisting of two bits is selected in accordance with the temperature detected by the temperature sensor 26B and the state of the switch 26S and is set into the temperature flag register 26E. The switch 26S is operated by the user as mentioned above. The user can change over the switch 26S to A or B in accordance with the picture quality or the like. Due to this, a plurality of temperature threshold values can be provided for the flags, the number of flags can be reduced, and a hardware construction can be simplified. The above temperature information is not supplied to the CPU side of the information processing system but is processed in the display control apparatus. Therefore, the CPU doesn't need to execute, for instance, an interrupting process in accordance with the temperature information and the whole hardware and software are simplified.

As mentioned above, the temperature of FLC panel 26A is detected and a predetermined flag value is set into the flag register 26E with reference to the temperature table on the basis of the detected temperature. One interlace flag information is selected in the interlace flag table memory 48 on the basis of the value of the flag register 26E and the value of the sampling counter 34. In the address conversion table 53, the table which is used in the address conversion is changed to the table according to the interlace flag information. For instance, when the value set in the register 26E is equal to "10" and the value of the sampling counter 34 is equal to "768", "11" is selected as interlace flag information and the table of the 4 interlace mode shown in FIG. 22 is selected.

With respect to the timing to change the table in the address conversion table memory 53, the table has been independently changed at any time in the embodiment. However, the table can be also changed in response to the generation of the HSYNC signal by, for example, controlling the address conversion table 53 by the sync controller 39.

The number of tables provided in the address conversion table memory 53 shown in FIG. 22, the kinds of interlace modes, and the like are also not limited to those shown in the embodiment.

As will be obviously understood from the above description, according to the invention, for example, the addresses of a plurality of scan lines consisting of a plurality of display elements on the display screen are generated form the address converting means such as an address conversion table or the like at an interval of those plurality of scan lines, so that those lines are accessed in what is called an interlace mode and their display state is updated.

The address converting means has a plurality of converting means and those converting means are changed in accordance with the temperature information and the number of lines to rewrite the display contents, so that the interlace mode can be made different in accordance with the temperature of FLC or the like constructing the display screen and the number of lines accessed from the CPU.

Thus, since a method of accessing the lines can be made different in accordance with the temperature of FLC panel, in particular, the flickering of the display screen when the temperature of FLC panel is low can be prevented. Since the method of accessing the lines can be made different in accordance with the number of lines accessed from the CPU, when the number of lines accessed from the CPU is small, by increasing a skipping degree of the addresses which are generated, the improper display of the image is prevented. On the contrary, when the number of lines accessed from the CPU is large, by decreasing the skipping degree of the addresses which are generated, the updating of the display without a feeling of physical disorder can be executed.

According to the invention, further in the scroll display mode, the areas and number of display elements regarding the change in display are relatively larger as compared with those of the display elements of the whole display screen, so that it is possible to detect that the display changing mode is the scroll display mode. On the basis of the result of such a detection, the display driving of the mode which is optimum to the scroll display can be performed.

Thus, the deterioration of the picture quality in the scroll display can be prevented and the character display in the scroll mode can be clearly recognized.

Further, according to the invention, in accordance with the selection of the icon, the interlace mode which is optimum to the display regarding the selected icon is selected from a plurality of interlace modes.

Thus, the display of a high display quality is always performed irrespective of the information which is displayed.

What is claimed is:

1. A display control apparatus comprising:

display means including display elements formed by continuous lines on which display data is displayed;

detecting means for detecting an area of said display means defined by lines of said display means in which the display data to be displayed on said display means is changed; and display driving means for displaying the display data in accordance with a size of the area which is detected by said detecting means, wherein said display driving means changes a duration of partial rewriting and a duration of total rewriting of said display means based on a number of lines in which a change in the display data is detected.

2. An apparatus according to claim 1, wherein said display elements comprise a ferroelectric liquid crystal.

3. An information processing system comprising:

storing means in which display data is stored;

supplying means for supplying the display data to the storing means;

display means on which the display data stored in said storing means is displayed;

detecting means for detecting a size of an area of the display means corresponding to the display data which is supplied to the storing means; and driving means for changing a duration of partial rewriting and a duration of total rewriting of said display means on the basis of the size of the area detected by said detecting means.

4. A system according to claim 3, wherein said detecting means has a plurality of reference tables, one of said tables for generating a signal to select a driving mode of said driving means.

5. A system according to claim 3, wherein said driving means has a plurality of tables and drives said display means on the basis of said tables.

6. A system according to claim 4, wherein said driving means has a plurality of tables and drives said display means on the basis of said tables.

7. A system according to claim 4, wherein said detecting means detects a scroll display and said driving means executes the display driving according to the scroll display.

8. A system according to claim 7, wherein said display means comprises a display screen with a plurality of scanning lines, and wherein the lines of the display screen are sequentially scanned during display driving.

9. A system according to claim 5, wherein said display means comprises a display screen including scanning lines, and wherein said plurality of tables includes a table for generating address data to sequentially scan the lines of the display screen and a table for generating address data to skip lines during scanning of the display screen.

10. A system according to claim 3, further comprising measuring means for measuring a temperature of said display means, wherein said driving means executes the display driving based on the size of the area detected and the temperature measured.

11. A system according to claim 10, wherein the temperature has priority over the size of the area in controlling display driving.

12. A system according to claim 3, wherein said display means includes display elements consisting of a ferroelectric liquid crystal material.

13. A display control method for controlling display means for displaying display data, comprising the steps of:

supplying display data to display on and to update the display means;

detecting a display area of the display means on which the display data is to be displayed to update the display means; and changing a duration of partial rewriting and a duration of total rewriting of the display means based on a size of the display are detected.

14. A method according to claim 13, further comprising the step of switching between driving modes based on the size of the display area detected when the display data is supplied.

* * * * *

UNITED STATES PATENT AND TRADEMARK OFFICE

CERTIFICATE OF CORRECTION

PATENT NO. : 5,644,332

DATED : July 1, 1997

INVENTOR(S) : Matsuzaki et al.

It is certified that error appears in the above-identified patent and that said Letters Patent is hereby corrected as shown below:

SHEET 14

Fig. 14, "501C" should read --510C--.

COLUMN 1

Line 56, "If" should read --It--.

COLUMN 5

Line 67, "supplies" should read --supplies it--.

COLUMN 7

Line 22, "hereinlatr," should read --hereinlater,--.

COLUMN 8

Line 10, "($N_1 \geq$ count" should read --($N_1 \leq$ count--.
Line 11, "($N_2 \geq$ count value $\geq N_1$), ($N_3 \geq$ count value $N_2$)," should read --($N_2 \leq$ count value $\leq N_1$), ($N_3 \leq$ count value $\leq N_2$),--.
Line 12, "(count value $\geq N_3$)." should read --(count value $\leq N_3$).--.
Line 50, "switch S3" should read --switch $S_3$--.

UNITED STATES PATENT AND TRADEMARK OFFICE

CERTIFICATE OF CORRECTION

PATENT NO. : 5,644,332

DATED : July 1, 1997

INVENTOR(S) : Matsuzaki et al.

It is certified that error appears in the above-identified patent and that said Letters Patent is hereby corrected as shown below:

COLUMN 9

Line 38, "lie." should read --line.--.

Line 61, "REF/$\overline{\text{AC}}$" should read --REF/$\overline{\text{ACS}}$--.

COLUMN 11

Line 62, "corresponding" should read --corresponding to--.

COLUMN 12

Line 1, "cuont" should read --count--.

COLUMN 13

Line 41, "iron" should read --icon--.
Line 58, "ad" should read --and--.

COLUMN 15

Line 52, "element" should read --elements--.

UNITED STATES PATENT AND TRADEMARK OFFICE

CERTIFICATE OF CORRECTION

PATENT NO. : 5,644,332

DATED : July 1, 1997

INVENTOR(S) : Matsuzaki et al.

It is certified that error appears in the above-identified patent and that said Letters Patent is hereby corrected as shown below:

COLUMN 16

Line 5, "generated" should read --generated by--.

COLUMN 19

Line 14, "form" should read --from--.

COLUMN 20

Line 60, "are" should read --area--.

Signed and Sealed this

Twenty-seventh Day of January, 1998

*Attest:*

*Attesting Officer*

BRUCE LEHMAN

*Commissioner of Patents and Trademarks*